US005436118A

United States Patent [19]

Carli et al.

[11] Patent Number: 5,436,118

[45] Date of Patent: Jul. 25, 1995

[54] METHOD OF PROCESSING SILVER HALIDE PHOTOGRAPHIC ELEMENTS USING A LOW VOLUME THIN TANK PROCESSING SYSTEM

[75] Inventors: Jerel R. Carli, Penfield; David G. Foster, West Henrietta; Edgar P. Gates, Honeoye; David L. Patton, Webster; John H. Rosenburgh, Hilton; Sheridan E. Vincent, Rochester, all of N.Y.

[73] Assignee: Eastman Kodak Company, Rochester, N.Y.

[21] Appl. No.: 221,711

[22] Filed: Mar. 31, 1994

[51] Int. Cl.[6] ..... G03C 7/00; G03D 3/02; G03D 5/04; G03D 13/04

[52] U.S. Cl. ..... 430/400; 430/30; 430/398; 430/399; 430/401; 430/403; 430/450; 430/963; 354/322; 354/324; 354/325; 354/331; 354/336

[58] Field of Search ..... 354/322, 324, 331, 336, 354/325; 430/963, 450, 403, 401, 400, 399, 398, 30

[56] References Cited

U.S. PATENT DOCUMENTS

| | | | |
|---|---|---|---|
| 2,401,185 | 5/1946 | Pratt et al. | 354/325 |
| 2,993,427 | 7/1961 | Lovercheck | 354/331 |
| 4,245,034 | 1/1981 | Libicky et al. | 430/399 |
| 4,328,306 | 5/1982 | Idota et al. | 430/393 |
| 4,613,562 | 9/1986 | Kuse et al. | 430/450 |
| 4,786,584 | 11/1988 | Endo | 430/434 |
| 4,791,048 | 12/1988 | Hirai et al. | 430/372 |
| 4,797,351 | 1/1989 | Ishikawa et al. | 430/387 |
| 4,977,067 | 12/1990 | Yoshikawa et al. | 430/398 |
| 4,997,749 | 3/1991 | Wernicke et al. | 430/464 |
| 5,004,676 | 4/1991 | Meckl et al. | 430/398 |
| 5,024,924 | 6/1991 | Naruse et al. | 430/379 |
| 5,043,756 | 8/1991 | Takabayashi et al. | 354/331 |
| 5,077,180 | 4/1991 | Yoshida et al. | 34/32 |
| 5,179,404 | 1/1993 | Bartell et al. | 354/320 |
| 5,243,373 | 9/1993 | Glover et al. | 354/331 |
| 5,270,762 | 12/1993 | Rosenburgh et al. | 354/324 |
| 5,294,956 | 3/1994 | Earle | 354/324 |
| 5,311,235 | 5/1994 | Piochinino, Jr. et al. | 354/336 |
| 5,347,337 | 9/1994 | Patton et al. | 354/336 |
| 5,353,083 | 10/1994 | Rosenburgh et al. | 354/331 |
| 5,353,086 | 10/1994 | Piccinino et al. | 354/336 |
| 5,353,087 | 10/1994 | Rosenburgh et al. | 354/336 |
| 5,353,088 | 10/1994 | Rosenburgh et al. | 354/336 |
| 5,355,190 | 10/1994 | Rosenburgh et al. | 354/325 |
| 5,361,114 | 11/1994 | Earle | 354/336 |

FOREIGN PATENT DOCUMENTS

| | | | |
|---|---|---|---|
| 314124 | 5/1989 | European Pat. Off. . | |
| 424820 | 5/1991 | European Pat. Off. . | |
| 559025 | 9/1993 | European Pat. Off. . | |
| 559026 | 9/1993 | European Pat. Off. . | |
| 559027 | 9/1993 | European Pat. Off. . | |
| 559028 | 9/1993 | European Pat. Off. . | |
| 559029 | 9/1993 | European Pat. Off. . | |
| 2622708 | 5/1989 | France | 354/322 |
| 2932595 | 2/1981 | Germany | 354/324 |
| 55-79446 | 6/1980 | Japan . | |
| 1-114843 | 5/1989 | Japan . | |
| 2-52343 | 2/1990 | Japan | 354/324 |
| 4-86660 | 3/1992 | Japan | 354/324 |
| 1397977 | 6/1975 | United Kingdom | 354/235 |
| WO89/04508 | 5/1989 | WIPO . | |
| WO90/08979 | 8/1990 | WIPO . | |
| 91-17482 | 11/1991 | WIPO | 354/324 |
| WO91/19226 | 12/1991 | WIPO . | |
| WO93/00612 | 1/1993 | WIPO . | |

*Primary Examiner*—Charles L. Bowers, Jr.
*Assistant Examiner*—J. Pasterczyk
*Attorney, Agent, or Firm*—J. Lanny Tucker; Sarah Meeks Roberts

[57] ABSTRACT

A method of processing an imagewise exposed silver halide photographic element comprising developing and desilvering the photographic element in a low volume thin tank processor wherein the processor operates at 15% or less of maximum production capacity.

22 Claims, No Drawings

METHOD OF PROCESSING SILVER HALIDE PHOTOGRAPHIC ELEMENTS USING A LOW VOLUME THIN TANK PROCESSING SYSTEM

FIELD OF THE INVENTION

This invention relates to the processing of silver halide photographic materials. It more specifically relates to the processing of such materials using a Low Volume Thin Tank processing system.

BACKGROUND OF THE INVENTION

Photographic processing equipment and processing chemicals have evolved dramatically over the last decade to meet the increasing demand for convenient, low cost, and environmentally friendly photoprocessing. Some of the changes have included improved processing chemicals which provide faster processing for both film and paper; and smaller, more streamlined equipment which requires a reduced amount of photochemicals. One of the most popular systems is the minilab which is small enough to allow any corner drugstore to offer photoprocessing and which can process a roll of film and provide prints in less than one hour.

However, even the advent of the minilab has not addressed all the needs and problems of modern photoprocessing. Two areas which particularly need addressing are 1) the increasing demand for photoprocessing capabilities in non-traditional photoprocessing environments and 2) the need to reduce the amount of replenishment necessary to keep a photoprocess system stable, both to decrease cost and to reduce the amount of effluent from processing machines. These two areas are often interrelated. In addition there is the never-ending desire to reduce processing time and/or the amount of chemicals needed to fully process various photographic materials.

The demand for non-traditional photoprocessing environments is being fueled by the increase of digital image processing. As digital image processing becomes more prevalent, there is a growing need for color hard copy from digital sources. Silver halide photographic hard copy can give the highest quality images, but is often found to be less convenient than electrophotographic or thermal technologies. Since the photographic processing of digital images would often be done in an office, home, or other non-traditional photoprocessing environments, the convenience of processing is of upmost importance.

Currently available processors can be inconvenient for home or office processing or for other small operations for the following reasons. First, the volume of the tank solutions that need to be prepared to fill a processor are still somewhat large for small-scale operations. Typical processor tank volumes of 10 to 25 liters for processor tanks require relatively large volumes of solutions to be handled.

Secondly, for low utilized systems, the processing solutions remain in the tank for a long residence time. The lack of 'tank-turnovers' with fresh replenisher causes the solutions to evaporate and the components to oxidize, causing the chemical concentrations of the components to change. This leads to process control variability and precipitate formation, both of which can affect sensitometry. Such low utilization problems are one of the largest obstacles for small-scale operations when using traditional processing equipment.

Lastly, the relatively high silver coverages of current films and papers require higher chemical concentrations in the processing solutions, which contributes to the cost of the chemicals. It further results in a concentration of chemicals in the waste from the processor which may make disposal of the waste difficult for a home, office, or other small-scale operations.

The need to reduce the amount of replenishment is driven by both cost and environmental concerns and is shared by large and small processors. Photographic processors are equipped with replenisher solutions designed to maintain process activity at a steady-state, as sensitized goods are processed. The replenishers contain the necessary components to replace chemicals consumed or lost through oxidation or carryover in developing, bleaching, fixing and washing and/or stabilization of sensitized materials.

In automated systems, as sensitized materials are processed, a signal is relayed to turn on the replenisher pumps, so that fresh solution is added to the process tanks. The rates that the solutions are added to the process are dependent on the concentration of components which can be attained in the replenisher solutions.

The replenishment rate in a processing system is set at the lowest rate possible. This reduces the effluent from the process, lowers handling of chemicals, reduces the amount of chemicals used, and reduces the energy needed to maintain operating temperatures. However, the amount replenishment can be reduced is dependent on the following factors.

1. Replenisher Stability—Once all components are combined into a single solution, the components begin reacting with each other and with oxygen, limiting the usefulness of the solution to the stability of the components. The usefulness of a mixed replenisher is normally 4–8 weeks, but may be as short as a few days. Solution stability may be enhanced by the use of covers which sit on top of the solution, eliminating air space which allows oxidation and evaporation.

2. Concentrate Stability—Because of the reactivity of the various components with each other and with oxygen, it is necessary to separate the replenisher concentrates into two or more parts until they are to be used. Concentrates are normally stable for several years if properly stored.

3. Productivity—The quantity of sensitized material processed daily is of concern, since low replenishment rates cause the tank solutions to be resident in the tanks for longer periods of time, subjecting them to oxidation, evaporation and interaction degradation.

4. Carryover—Carryover is the solution carried over from one tank into the next with the sensitized materials. The lower the carryover, the more stable the solutions. When very little or no solution is carried over into the next tank, less dilution occurs and less replenisher is needed in the next tank and less chemical interaction takes place. If the carryover is high, more solution is carried over and more replenisher is needed to compensate for dilution and chemical interactions. If the carryover out of the tank is greater than the replenishment rate, the tank volume will decrease. This results in a shift in the process activity due to the resulting volume loss. This loss reduces the time the sensitized material is in the solution and could lead to processor malfunction. If tank volume is lost, processing solution must be added to maintain solution level.

5. Evaporation-Oxidation—Evaporation and oxidation take place constantly with all processors. To control them, the area of solution exposed to the air needs be kept to a minimum. A surface which results in considerable evaporation and oxidation is the surface of rollers which are used to transport the sensitized material from one tank to another. Some processors have rollers which are partially submerged in the process solutions. The continual wetting and drying of these rollers increases evaporation and oxidation of the processing solutions. It is advantageous to have rollers either completely submerged or completely out of solution. Another way to reduce evaporation and oxidation is to reduce the flow of air over the solutions.

6. Tank turnover—Tank turnover (TTO) is the time required to replace the process tank solution with fresh replenisher solution. Reducing the replenishment rate of solutions extends the residence time of the solutions in the processor, increasing the time per tank turnover. To reduce the time per TTO and replenishment rate, it is necessary to reduce the volume of the processor tanks or increase the utilization (productivity) of the processor. Reducing the volume of the tanks or increasing the utilization of the processor, will decrease the time per tank turnover and reduce the residence time of the solutions.

7. Precipitation/Crystallization—Components which are present in the tank solutions may increase in concentration due to seasoning (processing of sensitized materials) or because of evaporation. Because of their solubility, the components may precipitate or crystallize from solution. The increase of the level of certain components may cause the precipitation or crystallization of other components by reducing their solubility. The lower the replenishment rate, the more likely that this will occur.

8. Process by-product buildup—Materials washing out of the sensitized product, such as, sensitizing dyes, halides, calcium, silver, which accumulate in the solutions as they season out of the sensitized materials, or as they are formed from reactions during photoprocessing, may also precipitate or crystallize.

9. Pump accuracy—As the replenishment rates are reduced, the need for high accuracy, low-volume pumps becomes imperative.

In particular, the amount of replenishment necessary is dependent on the level of utilization of the processor. When a traditional processing system has low utilization it cannot be operated using a low replenishment regime because the system is not stable.

The industry has attempted to compensate for low utilization problems and disposal problems by adjusting processing chemistry. For example, minilab film and paper processors run through a wide range of utilizations. One unit may experience a wide change of utilizations depending on the time of the year and picture taking opportunities. A variety of developer solutions have been made available to accommodate most situations. EKTACOLOR RA Developer Replenisher was formulated to accommodate the widest range of utilizations or tank turnovers within a given period of time. EKTACOLOR RA Developer Replenisher or EKTACOLOR PRIME Developer Replenisher will perform as designed, if the process maintains one tank turnover every 2 to 4 weeks or less. This product will perform equally as well if the process is run at higher utilizations, but may begin to fail if the developer tank is turned over less frequently than every 4 weeks. In this case, EKTACOLOR RA Developer Replenisher RT is recommended. This product has additional preservative and an increased replenishment rate to compensate for evaporation and oxidation. Under extreme conditions, EKTACOLOR RA Developer Additive can be used.

For minilabs running at consistently higher utilizations, where the tank is turned over at least every two weeks, EKTACOLOR RA 100 Developer Replenisher and EKTACOLOR RA 100 Developer Regenerator have been formulated. At this high of a utilization, there is less need for high preservative and color developer levels. In reducing the preservative and color developer levels, the environmental impact of the developer overflow to the sewer is reduced.

Because of the stringent utilization requirements of EKTACOLOR RA 100 Developer, many minilabs could not take advantage of the environmental benefits of the product and therefore could not use it. EKTACOLOR PRIME Developer was formulated to give most of the environmental benefits of EKTACOLOR RA 100 Developer, but the utilization freedom of EKTACOLOR RA Developer.

The formulation of Developer Regenerators allowed for environmental advantages by reusing some (for example 60%) of the overflow to prepare the developer replenisher. This effectively reduces the replenishment rate by 60% and reduces the chemicals being sewered. Therefore, a 15 mL/ft$^2$ replenishment rate is effectively the same as a 6 mL/ft$^2$ rate. Regenerators were formulated for both EKTACOLOR RA 100 and EKTACOLOR PRIME Developers.

All of the above developers have counterpart bleach-fix solutions. EKTACOLOR RA Bleach-Fix Replenisher was formulated to accommodate the widest range of utilizations at 20 mL/ft$^2$. If the bleach-fix tank is turned over less frequently than every 4 weeks, EKTACOLOR RA Bleach-Fix Replenisher with Bleach-Fix additive is recommended. This product has additional preservative to compensate for evaporation and oxidation.

For minilabs running at consistently higher utilizations; EKTACOLOR RA 100 Bleach-Fix Replenisher can be used in conjunction with EKTACOLOR RA 100 Developer Replenisher and EKTACOLOR RA 100 Developer Regenerator. Where the tank is turned over at least every 2 weeks, EKTACOLOR RA 100 Bleach-Fix Replenisher has been formulated to be replenished at 5 ml/ft$^2$, reducing the environmental impact of the bleach-fix. EKTACOLOR PRIME Bleach-Fix Replenisher was formulated to be used with EKTACOLOR PRIME Developer Replenisher. EKTACOLOR PRIME Bleach-Fix is formulated to be replenished at 10 ml/ft$^2$.

To minimize bleach-fix effluent to the sewer, EKTACOLOR RA Bleach-Fix DRep was formulated for high volume labs. This formulation would be directly replenished, reducing the replenishment rate to 1.4 ml/ft$^2$. The three part concentrates are added to processors directly, but this requires additional high accuracy pumps. With such a significant replenishment reduction in large processing tanks, the utilization and tank turnover rate is of major significance. The long solution residency results in degradation of the tank solution.

Most Minilab paper processors have been designed to operate "plumbless" (no water connections needed for washing of the prints or drains needed to dispose of effluents). To achieve a plumbless processor, it was necessary to design a wash system which allowed for the reduction of wash-water volume. This is accomplished with a stabilizer which stabilizes the solution, prevents processing by-products from being deposited on the prints or the tank walls, and incorporates a biocide. The processors have been designed with four stabilizer tanks plumbed countercurrent, recirculated and heated. Fresh stabilizer is replenished into the fourth or final tank at 23 ml/ft$^2$.

However, all of the above options involve the need to purchase and use different processing solutions for varying utilization conditions, a situation that can be confusing to the user. The development regenerators, while very effective at reducing effluent, involve additional equipment and operating steps which may be inconvenient for small-scale operations. Further, none of the above solutions are stable at very low utilization.

Current technology is reaching its limits with regard to size and processing capability. Problems of the small-scale operation such as low utilization, tank size, and processing cost cannot be fully addressed with alterations to existing equipment. Additionally, the ability to significantly reduce replenishment rates below current standards with existing equipment and chemistry no longer exists. Further, traditional systems have been maximized with regard to processing parameters. There is little flexibility left to reduce processing time or chemical consumption.

SUMMARY OF THE INVENTION

This invention provides a method of processing an imagewise exposed silver halide photographic element comprising developing and desilvering the photographic element in a low volume thin tank processor wherein the processor operates at 15% or less of maximum production capacity.

It further provides a method of processing an imagewise exposed silver halide photographic element comprising developing the silver halide element in a developing solution, in a low volume thin tank processor, wherein the developing solution is replenished by direct replenishment. It also provides a method of processing an imagewise exposed silver halide photographic element comprising desilvering the photographic element in a bleach-fix solution or in a bleaching solution and fixing solution, in a low volume thin tank processor, wherein the bleach-fix solution or bleaching solution and fixing solution are replenished by direct replenishment.

The processor of this invention has a Low Volume Thin Tank (LVTT) rack and tank design more fully described hereafter. This processor may be utilized with all standard color-negative and professional films and all color papers sensitized-to be exposed via digital means and/or by conventional optical exposure. The processor may be utilized with all standard color film and paper chemistry, or variations on such chemistry designed to take full advantage of the LVTT concept.

ADVANTAGES OF THE INVENTION

This invention provides consistent, high quality film processing and prints from digital and/or optical sources. The improved chemical reaction rates from the high-impingement agitation rack design allows additional flexibility in the processing system which can be taken as 1) reduced process time; 2) reduced process temperature; 3) reduced chemical concentrations; or 4) any combination of points 1 to 3. The increased process activity also allows for further replenishment rate reductions and lower chemical waste volume due to greater processing efficiency. LVTT technology, with its high agitation, would also be expected to enable prints to be washed more efficiently in a shorter period of time.

The LVTT technology of this invention further provides a small compact processor which is convenient for use in a small space. LVTT technology, with its significant volume reduction, reduces the time needed to warm the solutions to operating temperature. A processor with 18 Litre tanks takes 45 minutes to an hour to come to operating temperature, whereas an LVTT processor takes 15–20 minutes. The cost to dump the chemical solutions from an LVTT system is greatly reduced because of lower volumes to be discarded (hauled away) and less downtime; that is, time required to drain, remix and reheat to temperature. A system dump and restart which normally-takes 4–6 hours, now will take only 1–2 hours. The energy to maintain a processor during low utilization times is lower, both to maintain the operating temperature, and on standby mode.

The reduction in tank volume reduces the chemicals needed to start up the processor. Further, it allows significant reductions in area of the solution exposed to air resulting in reduced loss caused by oxidation and evaporation. The reduced effects of oxidation and evaporation help to maintain stability in a system which has a low utilization rate.

The low tank volume and reduced oxidation and evaporation also allows for low replenishment rates. It particularly allows direct replenishment of concentrates. The use of concentrates eliminates operator labor by eliminating the need to mix replenishers and also minimizes operator contact with process solutions.

Other advantages of a direct replenishment system in combination with an LVTT system are as follows: 1) the replenishers are not prepared, so the stability of replenishers is not an issue; 2) the concentrates may be placed into special containers and need not be removed for mixing the concentrates, thereby maintaining their integrity; 3) the reduced volumes eliminates the need for high productivity to give acceptable solution stability; 5) the use of concentrates eliminates the concern of oxidation of replenishers; 6) with the reduced volume and the reduced evaporation and oxidation resulting from LVTT, the time per tank turnover (TTO) is decreased and direct replenishment technology is enhanced, making low utilization less of an issue; 7) even with direct replenishment, the reduced residency time of solutions in the tanks reduces the chances of precipitates and crystals forming and reduces the chances of byproduct buildup which can have an adverse effect on process solutions.

This system also provides improved developability and speed/fog relationships in the photographic material. The improved developability of the high-agitation LVTT results from the increased rate of development resulting from the more effective refreshment of developer reactants and removal of by-products that form as a result of the development reaction. While this effect would be readily observed with emulsions that have a grain size in the range of from 0.10 to 1.0 microns in edge length, the improvement with LVTT should be even more noticeable and beneficial with larger grain size emulsion, in the range of from 1.0 to 2.0 microns in edge length. While these emulsions are typically cubic, the morphology could cover a broad range of forms.

The LVTT can improve the speed/fog relationship because the LVTT processor can decrease the time needed to reach maximum density in a multilayer format. In the development step it is typical for the sensitized layer closest to the support in a multilayer format to develop last when all the layers are exposed. An example is the yellow emulsion layer in Kodak EKTACOLOR EDGE Paper. The layers above the layer closest to the support consume developer and in so doing, slow down development of the bottom layer. In addition, the yellow layer in Kodak EKTACOLOR EDGE Paper, for example, contains the largest grain size emulsions in the overall structure. For these reasons the development time of a multilayer structure is typically greater than that needed for a single-layer coating. Conversely, if only the bottom layer of a multilayer format was exposed to light, maximum density could be reached in half the normal development time. The non-exposed minimum density-of the bottom layer of a multilayer structure would therefore be subjected to the full developer concentration for a much longer time than the fully-exposed maximum density region.

It is known that as the sensitivity (emulsion speed) of a given silver halide is increased through formulation changes that eventually an increase in the minimum density region is observed that is independent of exposure. Formulation changes that can increase speed include chemicals for sensitization, speed-enhancing addenda, and formulation procedures in any speed-enhancing sensitization step and would include time and temperature increases as examples. Since development of the bottom layer of a fully-exposed multilayer is limiting and requires added development time, the amount of silver halide sensitivity achieved is limited by the amount of minimum density increase (fog) that can be tolerated.

An LVTT processor decreases the time needed to reach maximum density of a multilayer format because of the increased process activity. Therefore the LVTT in combination with various silver halide sensitizations can result in formulations of higher sensitivity without a penalty for high minimum density (fog). This could be found to be the case with many different developer formulations in a variety of applications.

DETAILED DESCRIPTION OF THE INVENTION

The processors utilized with this invention are Low Volume Thin Tank processors. A Low Volume Thin Tank processor provides a small volume for holding the processing solution. As a part of limiting the volume of the processing solution, a narrow processing channel is provided. The processing channel, for a processor used for photographic paper, should have a thickness equal to or less than about 50 times the thickness of the paper being processed, preferably a thickness equal to or less than about 10 times the paper thickness. In a processor for processing photographic film, the thickness of the processing channel should be equal to or less than about 100 times the thickness of photosensitive film, preferably, equal to or less than about 18 times the thickness of the photographic film. An example of a low volume thin tank processor which processes paper having a thickness of about 0.008 inches would have a channel thickness of about 0.080 inches and a processor which processes film having a thickness of about 0.0055 inches would have a channel thickness of about 0.10 inches.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

Typically the amount of processing solution available in the system will vary on the size of the processor, that is, the amount of photosensitive material the processor is capable of processing. For example, a typical prior art microlab processor, a processor that processes up to about 5 $ft^2$/min. to about 15 $ft^2$/min. of photosensitive material (which generally has a transport speed less than about 80 inches per minute) has about 17 liters of processing solution as compared to about 5 liters for a low volume thin tank processor. With respect to typical prior art minilabs, a processor that processes from about 5 $ft^2$/min. to about 15 $ft^2$/min. of photosensitive material (which generally has a transport speed less than about 80 inches/min. to about 150 inches/min.) has about 100 liters of processing solution as compared to about 10 liters for a low volume processor. Large prior art lab processors that process up to 90 $ft^2$/min. of photosensitive material (which generally have transport speeds of about 7 to 70 ft/min.) typically have from about 120 to 1,200 liters of processing solution as compared to a range of about 15 to 100 liters for a low volume large processor. A minilab size low volume thin tank processor made in accordance with the present invention designed to process 15 $ft^2$ of photosensitive material per min. would have about 7 liters of processing solution.

Preferably the system is a high impingement system, such as described hereafter, In order to provide efficient flow of the processing solution through the nozzles into the processing channel, it is desirable that the nozzles/opening that deliver the processing solution to the processing channel have a configuration in accordance with the following relationship:

$$1 \leqq F/A \leqq 40$$

wherein:

F is the flow rate of the solution through the nozzle in gallons per minute; and A is the cross-sectional area of the nozzle provided in square inches.

Providing a nozzle in accordance with the foregoing relationship assures appropriate discharge of the processing solution against the photosensitive material.

Specific embodiments of an LVTT processor are described in detail in the following documents, incorporated herein by reference.

| Title | Pub. No. or Appln. No | Pub. Date |
|---|---|---|
| PHOTOGRAPHIC PROCESSING APPARATUS | WO 92/10790 | 25JUN92 |
| PHOTOGRAPHIC PROCESSING APPARATUS | WO 92/17819 | 15OCT92 |

-continued

| Title | Pub. No. or Appln. No | Pub. Date |
|---|---|---|
| PORTABLE FILM PROCESSING UNIT | WO 93/04404 | 03MAR93 |
| CLOSURE ELEMENT | WO 92/17370 | 15OCT92 |
| PHOTOGRAPHIC PROCESSING TANK | WO 91/19226 | 12DEC91 |
| METHOD AND APPARATUS FOR PHOTOGRAPHIC PROCESSING | WO 91/12567 | 22AUG91 |
| PHOTOGRAPHIC PROCESSING APPARATUS | WO 92/07302 | 30APR92 |
| PHOTOGRAPHIC PROCESSING APPARATUS | WO 93/00612 | 07JAN93 |
| PHOTOGRAPHIC PROCESSING APPARATUS | WO 92/07301 | 30APR92 |
| PHOTOGRAPHIC PROCESSING APPARATUS | WO 92/09932 | 11JUN92 |
| PROCESS RACK INTEGRAL WITH PUMPS | US 5,294,956 | 15MAR94 |
| A DRIVING MECHANISM FOR A PHOTOGRAPHIC PROCESSING APPARATUS | EP 559,027 | 08SEP93 |
| ANTI-WEB ADHERING CONTOUR SURFACE FOR A PHOTOGRAPHIC PROCESSING APPARATUS | US 5,179,404 | 12JAN93 |
| A RACK AND A TANK FOR A PHOTOGRAPHIC PROCESSING APPARATUS | EP 559,025 | 08SEP93 |
| A SLOT IMPINGEMENT FOR A PHOTOGRAPHIC PROCESSING APPARATUS | US 5,270,762 | 14DEC93 |
| RECIRCULATION, REPLENISHMENT, REFRESH, RECHARGE AND BACKFLUSH FOR A PHOTOGRAPHIC PROCESSING APPARATUS | EP 559,026 | 08SEP93 |
| AUTOMATIC TRAY PROCESSOR | USSN 057,250<br>USSN | 03MAY93<br>10MAR94 |
| MODULAR PROCESSING CHANNEL FOR AN AUTOMATIC TRAY PROCESSOR | USSN 056,458<br>USSN | 03MAY93<br>10MAR94 |
| COUNTER CROSS FLOW FOR AN AUTOMATIC TRAY PROCESSOR | USSN 056,447<br>USSN | 03MAY93<br>10MAR94 |
| VERTICAL AND HORIZONTAL POSITIONING AND COUPLING OF AUTOMATIC TRAY PROCESSOR CELLS | USSN 057,131<br>USSN | 03MAY93<br>10MAR94 |
| TEXTURED SURFACE WITH CANTED CHANNELS FOR AN AUTOMATIC TRAY PROCESSOR | USSN 056,451<br>USSN | 03MAY93<br>10MAR94 |
| AUTOMATIC REPLENISHMENT, CALIBRATION AND METERING SYSTEM FOR AN AUTOMATIC TRAY PROCESSOR | USSN 056,730<br>USSN | 03MAY93<br>10MAR94 |
| CLOSED SOLUTION RECIRCULATION/SHUTOFF SYSTEM FOR AN AUTOMATIC TRAY PROCESSOR | USSN 056,457<br>USSN | 03MAY93<br>10MAR94 |
| A SLOT IMPINGEMENT FOR AN AUTOMATIC TRAY PROCESSOR | USSN 056,649<br>USSN | 03MAY93<br>10MAR94 |
| A RACK AND A TANK FOR A PHOTOGRAPHIC LOW VOLUME THIN TANK INSERT FOR A RACK AND A TANK PHOTOGRAPHIC PROCESSING APPARATUS | USSN 020,311 | 19FEB93 |
| AUTOMATIC REPLENISHMENT, CALIBRATION AND METERING FOR A PHOTOGRAPHIC PROCESSING | USSN 056,455 | 03MAY93 |

The processors of this invention are particularly useful in low utilization conditions. Low utilization is defined as a percentage of maximum production capacity. Current processors, particularly minilabs, often do not operate at or near their maximum production capacity. A processor maximum production capacity is simply the maximum number of rolls or prints that can be processed in a given time frame. This is usually based on 24 prints from a 35 mm photographic element. When a processor is being operated at a small percentage of its maximum capacity, low-utilization effects due to evaporation and oxidation of chemical components occur causing the process to go out of control. Low utilization is when a processor is operating at less than 15% of maximum production capacity, and particularly at less than 10% maximum production capacity. For example, a roller transport processor operating at less than 15% maximum production capacity is operating under low utilization conditions. (see "USING KODAK EKTACOLOR CHEMICALS" Kodak Publication Z-130) The Kodak Minilab System 25 Film Processor requires operation of at least 11% to 13% of the maximum capacity while the Kodak Minilab System 50 Film Processor can operate at 5% to 7% of the maximum and avoid low utilization problems.

For example, for a processor using Process RA-4 with a paper containing greater than 90 mole % silver chloride and less than 1.75 grams of silver per square meter of support, low utilization is when it takes longer than 28 days to replace the contents of the developer tank with fresh replenisher solution (one tank turnover). With a standard negative film process used with bromoiodide films, such as Process C-41, one complete developer tank volume needs to be replaced with replenisher within 21 days to avoid low-utilization concerns.

The LVTT processing system is particularly useful with direct replenishment. In an LVTT processor the chemistry does not become unstable at the very low replenishment rate possible with direct replenishment. This is not true for standard processors when they are operated under low utilization conditions.

Direct replenishment is the replenishment of concentrates directly into the process tanks, Without the need to prepare replenisher solutions. Each concentrate is added separately and mixed in the processor using high accuracy pumps.

Whether replenishers or regenerators, the concentrates are made available as multiple parts because of the incompatibility of the components at the high concentrations and over a long period of time. Each part of the concentrate contains process solution components at or near their solubility level. Examples of preferred developer and bleach fix concentrates are shown in Example 4.

Use of such direct replenishment with an LVTT processor allows for a developer replenishment rate of 10 mls/square ft or less, more preferably 6 mls/square ft or less, and most preferably 4 mls/square ft or less for color paper. It further allows for a bleach-fix replenishment rate of 10 mls/square ft or less, more preferably 5 mls/square ft or less, and most preferably 2 mls/square ft or less for color paper. For film it allows a developer replenishment rate of 20 mls/roll or less, and more preferably 15 mls/roll or less. It further allows for a bleach replenishment rate of 5 mls/roll or less, a fixer replenishment rate of 35 mls/roll or less, and more preferably 30 mls/roll or less., and a stabilizer replenishment rate of 40 mls/roll or less, and more preferably 30 mls/roll or less (a roll is 35mm-24 exposure having an area of 0.42 square feet according to the ANSI standard).

The photographic elements to be processed can contain any of the conventional silver halides as the photosensitive material, for example, silver chloride, silver bromide, silver bromoiodide, silver chlorobromide, silver chloroiodide, and mixtures thereof. Preferably, however, the photographic element is a high chloride element, containing at least 50 mole % silver chloride and more preferably 90 mole % silver chloride. The preferred silver content of the photographic element is less than 1.75 grams per square meter and more preferably 0.80 grams per square meter. Another preferred embodiment is a bromoiodide film element.

The materials of the invention can be used with photographic elements in any of the ways and in any of the combinations known in the art. Typically, photographic materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or-"ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 40 carbon atoms. Such substituents can also be further substituted.

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, acylamino, sulfonamide, alkylthio, arylthio, alkenyl, cycloalkyl, and further to these exemplified are halogen, cycloalkenyl, alkinyl, heterocycle, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, spiro compound residues and bridged hydrocarbon compound residues.

The photographic elements can be single color elements or multicolor elements. Multicolor elements contain image dye-forming units-sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements that can be used in conjunction with elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "*Research Disclosure.*" The contents of the *Research Disclosure,* including the patents and publications referenced therein, are incorporated herein by reference, and the Sections hereafter referred to are Sections of the *Research Disclosure.*

The silver halide emulsions employed can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XII and XVII, processing methods and agents in Sections XIX and XX, and exposure alternatives in Section XVIII.

With couplers, the presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Even more preferable are the cyan couplers described in, for instance, European Patent Application Nos. 544,322; 556,700; 556,777; 565,096; 570,006; and 574,948.

Typical preferred cyan couplers are represented by the following formulas:

CYAN-1

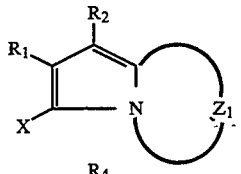

CYAN-2

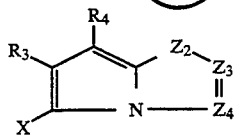

CYAN-3

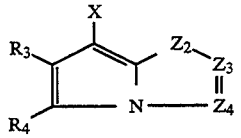

CYAN-4

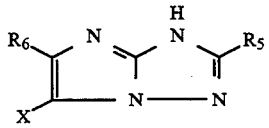

wherein $R_1$, $R_5$ and $R_8$ each represent a hydrogen or a substituent; $R_2$ represents a substituent; $R_3$, $R_4$ and $R_7$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)= and —N=; and $Z_3$ and $Z_4$ each represent —C($R_8$)= and —N=.

A dissociative group has an acidic proton, eg. —NH—, —CH(R)—, etc., that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, Lange's *Handbook of Chemistry,* 12th Ed. (1979) (McGraw-Hill).

Couplers that form magenta dyes upon reaction with oxidized color developing agent are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo

[1,5-b]-1,2,4-triazoles can be found in European Patent applications 176,804; 177,765; U.S Pat. Nos. 4,659,652; 5,066,575; and 5,250,400.

Typical pyrazolotriazole and pyrazolone coupler are represented by the following formulas:

MAGENTA-1

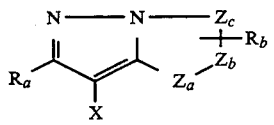

MAGENTA-2

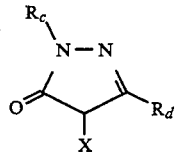

wherein $R_a$ and $R_b$ independently represent H or a substituent; $R_c$ is a substituent (preferably an aryl group); $R_d$ is a substituent (preferably an anilino, acylamino, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Couplers that form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Especially preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

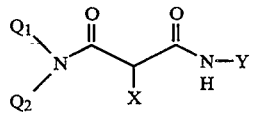

YELLOW-2

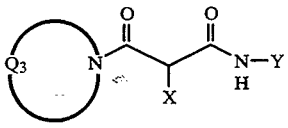

YELLOW-3

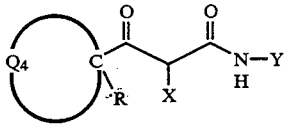

wherein R, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group.

Typical couplers that may be used with the elements of this invention are shown below.

Couplers

C-1

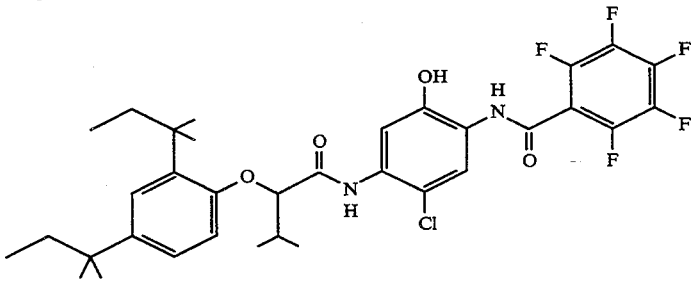

C-2

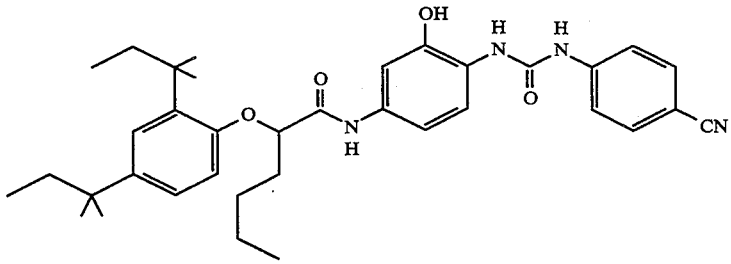

-continued
C-3
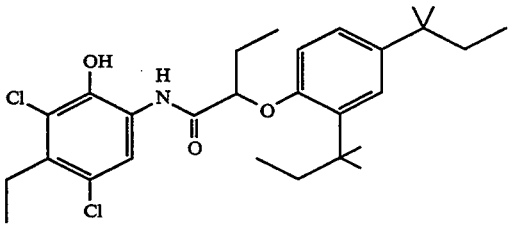
C-4
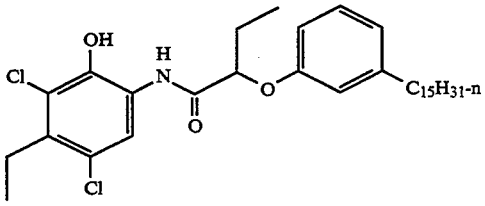
C-5
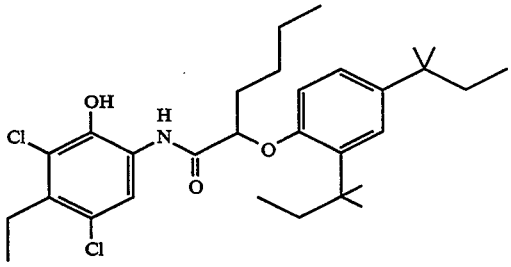
C-6
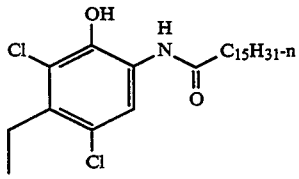
C-7
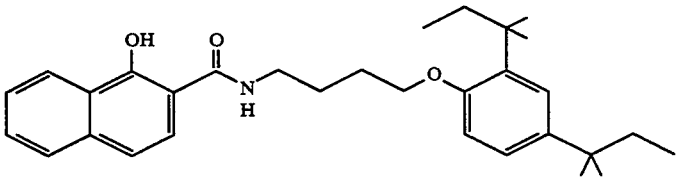
C-8
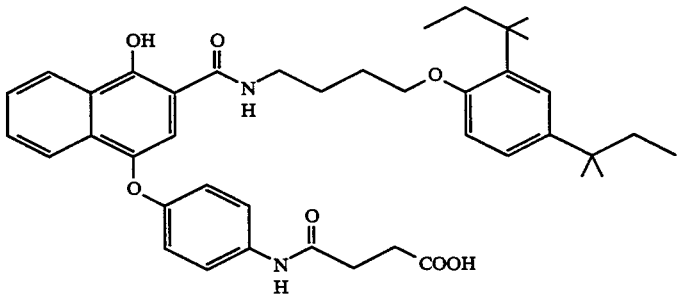
C-9
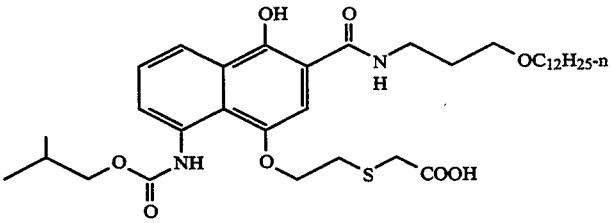

-continued
C-10
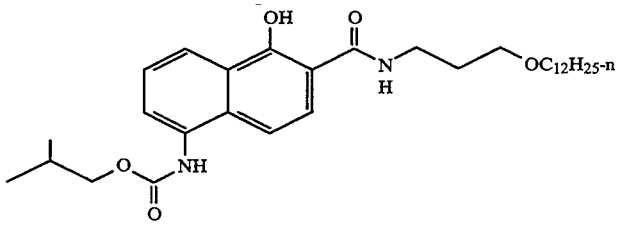
C-11
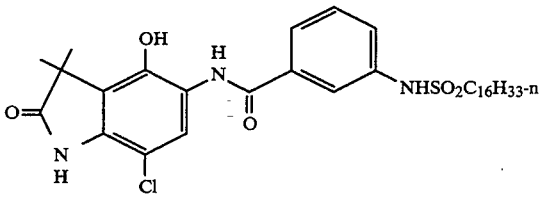
C-12
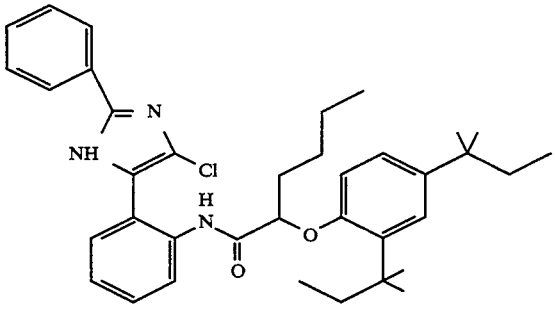
C-13
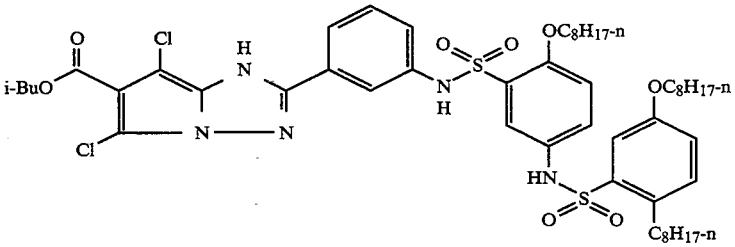
C-14
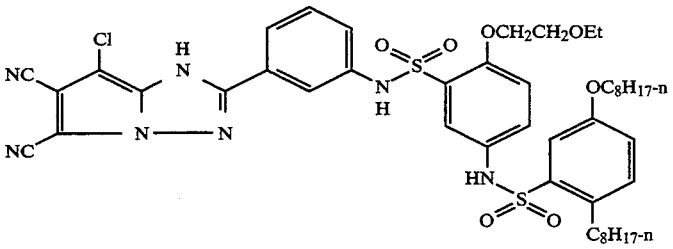
C-15
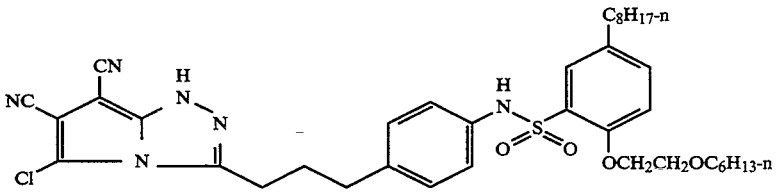

-continued
C-16
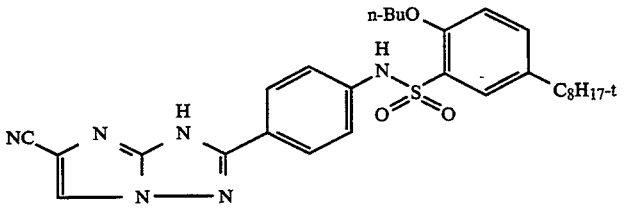
C-17
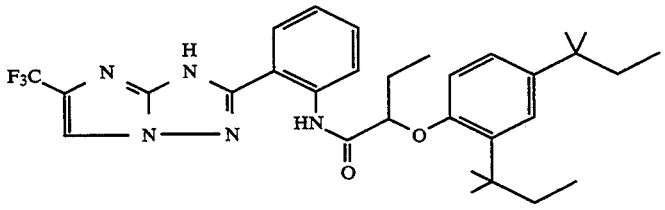
C-18
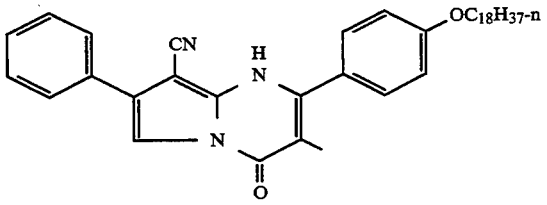
C-19
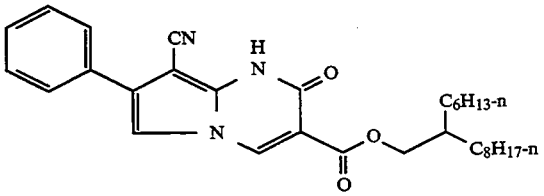
C-20
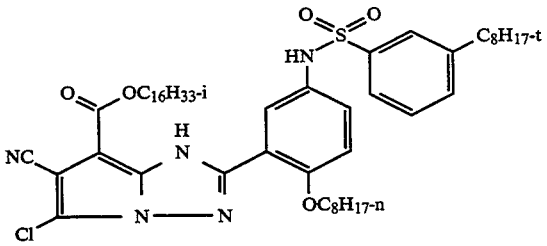
C-21
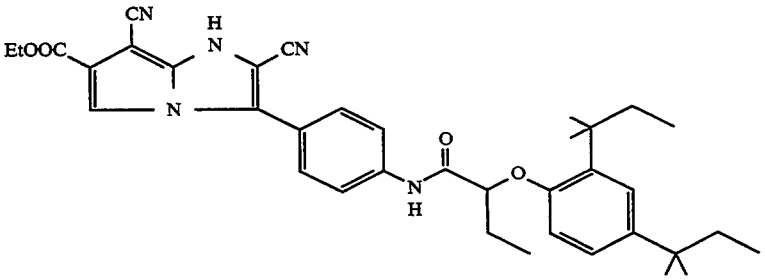

-continued
M-1
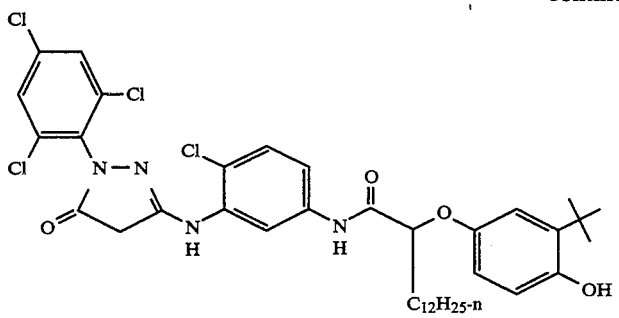
M-2
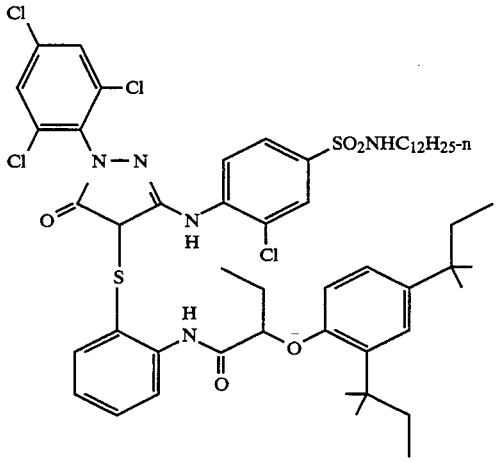
M-3
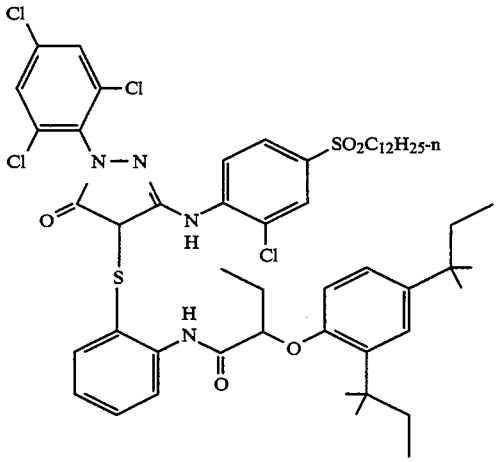
M-4
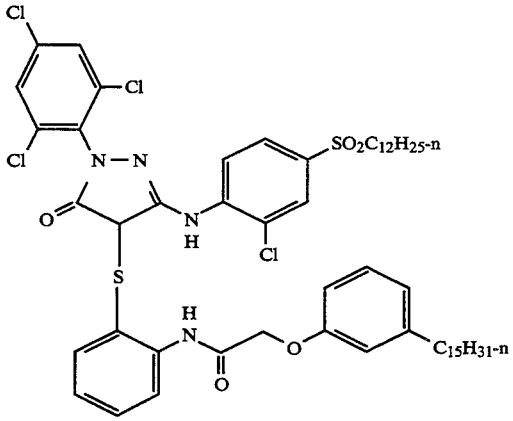

-continued
M-5
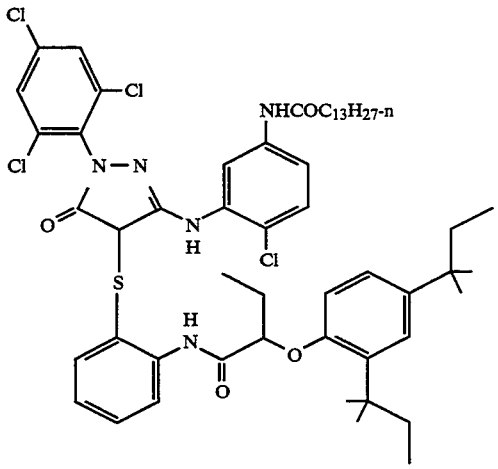
M-6
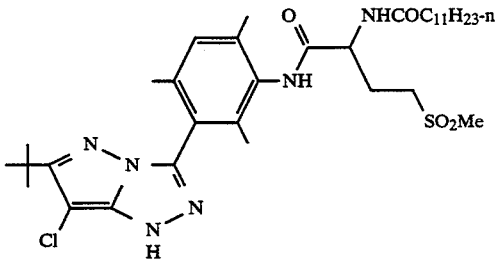
M-7
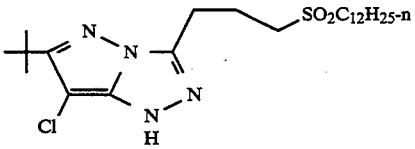
M-8
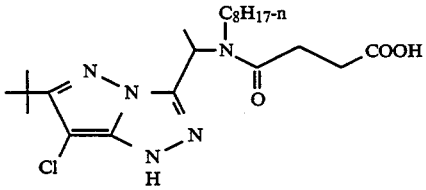
M-9
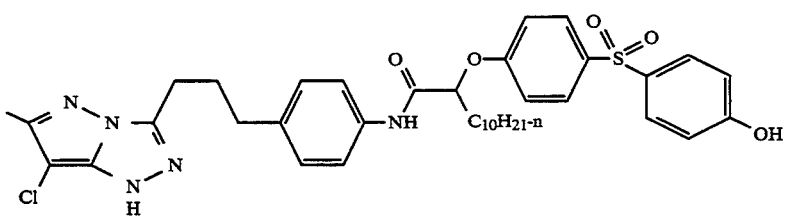
M-10
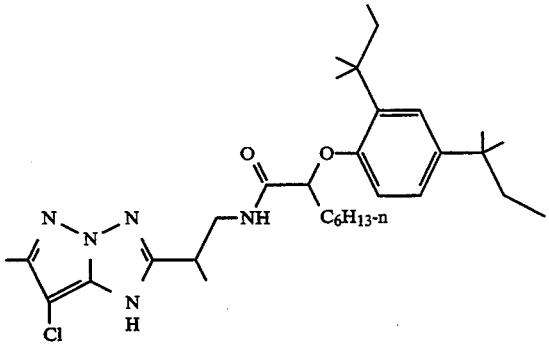

-continued
M-11
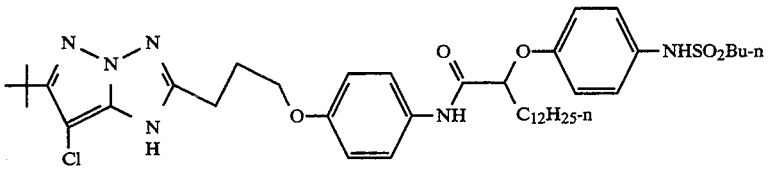
M-12
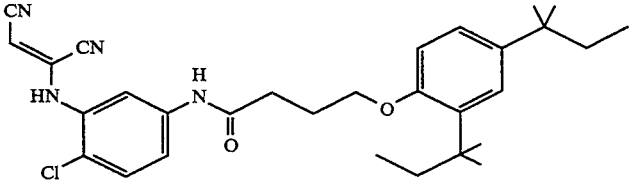
Y-1
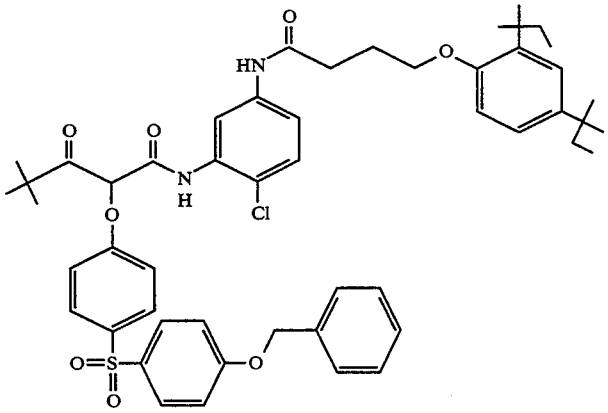
Y-2
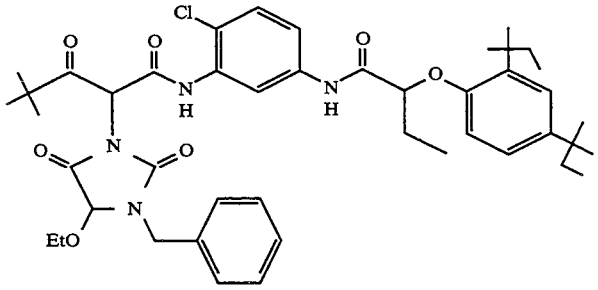
Y-3
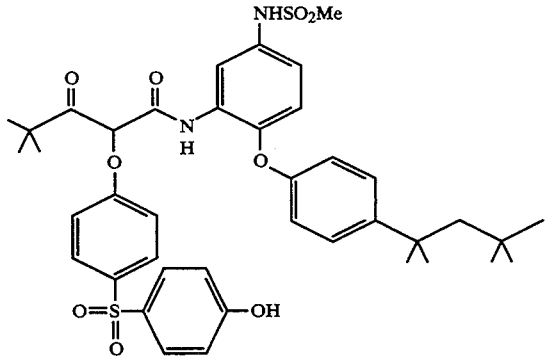

-continued
Y-4
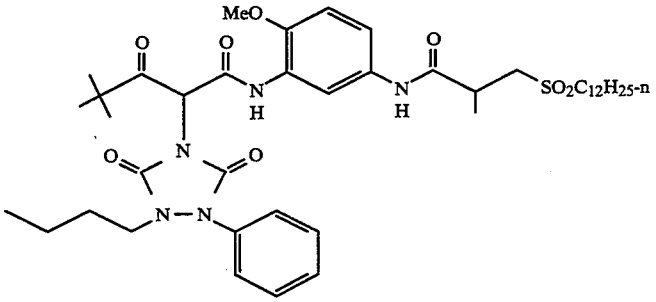
Y-5
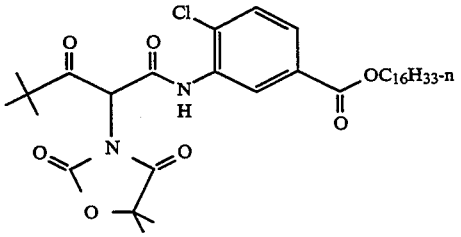
Y-6
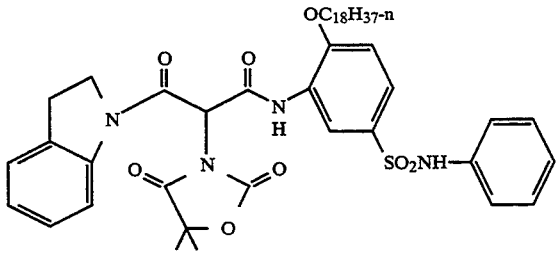
Y-7
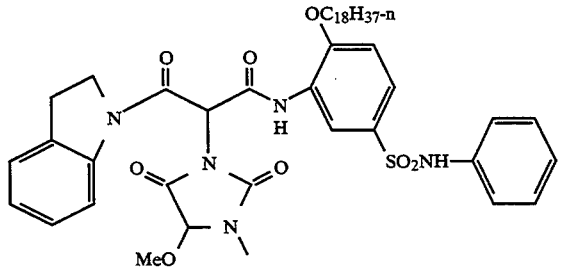
Y-8
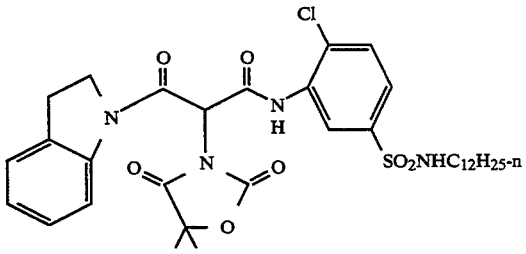
Y-9
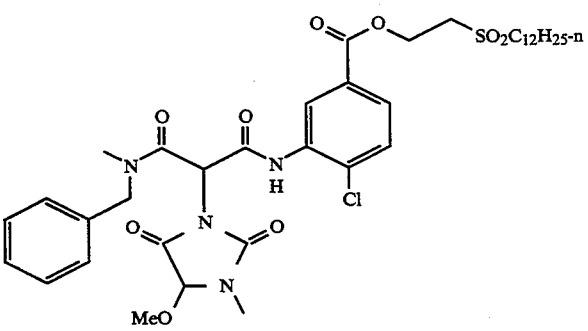

-continued

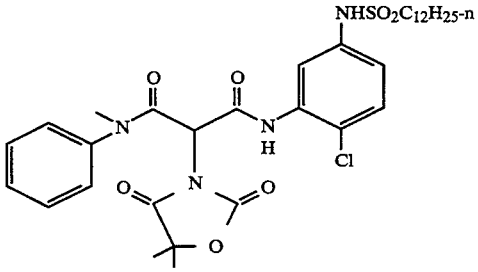

Y-10

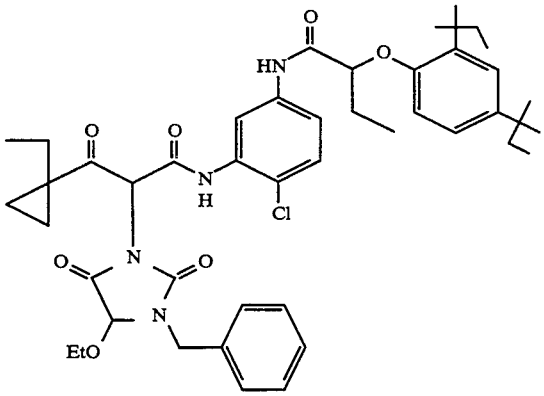

Y-11

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may also be used in association with "wrong" colored couplers (e.g. to adjust levels of interlayer correction) and, in color negative applications, with masking couplers such as those described in EP 213,490; Japanese Published Application 58/172,647; U.S. Pat. No. 2,983,608; German Application DE 2,706,117C; U.K. Patent 1,530,272; U.S. Pat. Nos. 4,070,191 and 4,273,861; and German Application DE 2,643,965. The masking couplers may be shifted or blocked.

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140 and U.K. Patent 2,131,188), electron transfer agents (U.S. Pat. No. 4,859,578 and U.S. Pat. No. 4,912,025); antifogging and anti color-mixing agents such as derivatives of hydroquinones, aminophenols, amines, gallic acid, catechol, ascorbic acid, hydrazides, sulfonamidophenols, and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-Δ,Δ,Δ',Δ'-tetramethyl-, dihexyl ester; 1,4-Benzenedipentanoic acid, 2-hydroxy-5-methoxy-Δ,Δ,Δ',Δ'-tetramethyl-, dihexyl ester; and 2,5-dimethoxy-Δ,Δ,Δ',Δ'-tetramethyl-, dihexyl ester.

Various kinds of discoloration inhibitors can be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat. Nos. 2,360,290, 2,418,613, 2,700,453, 2,701,197, 2,710,801, 2,816,028, 2,728,659, 2,732,300, 2,735,765, 3,982,944 and 4,430,425, and British Patent 1,363,921, and so on; 6-hydroxychromans, 5-hydroxycoumarans, spirochromans are disclosed in U.S. Pat. No. 3,432,300, 3,573,050, 3,574,627, 3,698,909 and 3,764,337, and Japanese Published Patent Application 52/152,225, and so on; spiroindanes are disclosed in U.S. Pat. No. 4,360,589; those of p-alkoxyphenols are disclosed in U.S. Pat. No. 2,735,765, British Patent 2,066,975, Japanese Published Patent Applications 59/010,539 and 57/019,765, and so on; hindered phenols are disclosed, for example, in U.S. Pat. Nos. 3,700,455, 4,228,235, Japanese Published Patent Applications 52/072,224 and 52/006,623, and so on; gallic acid derivatives, methylenedioxybenzenes and aminophenols are disclosed in U.S. Pat. Nos. 3,457,079, 4,332,886, and Japanese Published Patent Application 56/021,144, respectively; hindered amines are disclosed in U.S. Pat. No. 3.336,135, 4,268,593, British Patents 1,326,889, 1,354,313 and 1,410,846, Japanese Published Patent Applications 51/001,420, 58/114,036, 59/053,846, 59/078,344, and so on; those of ether or ester derivatives of phenolic hydroxy groups are disclosed in U.S. Pat. Nos. 4, 155,765, 4,174,220, 4,254,216, 4,279,990, Japanese Published Patent Applications 54/145,530, 55/006,321, 58/105,147, 59/010,539, 57/037,856, 53/003,263 and so on; and those of metal complexes are disclosed in U.S. Pat. No. 4,050,938, 4,241,155, 4,346,165, 4,540,653 and 4,906,559.

Stabilizers that can be used in conjunction with elements of the invention include, but are not limited to, the following.

Stabilizers

ST-1

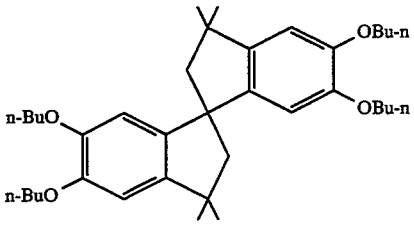

ST-2

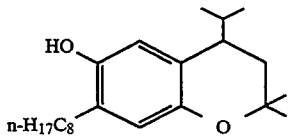

ST-3

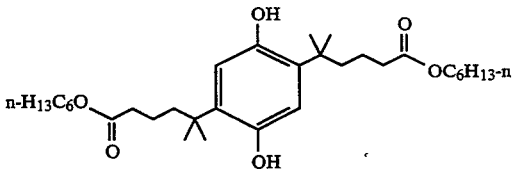

ST-4

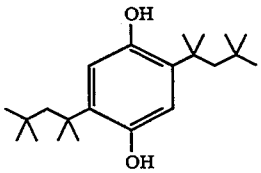

ST-5

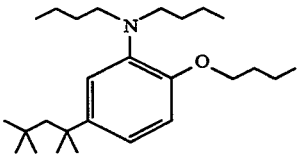

ST-6

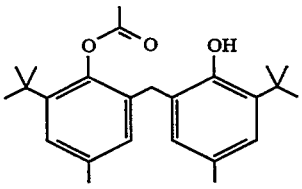

ST-7

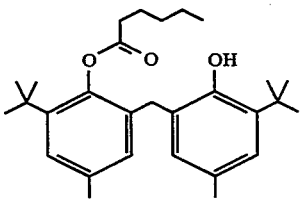

-continued

Stabilizers

ST-8

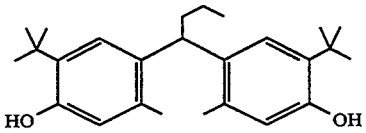

ST-9

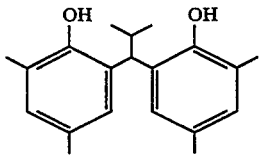

ST-10

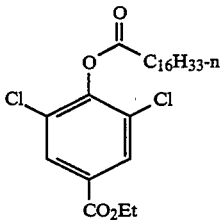

ST-11

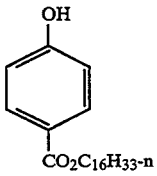

ST-12

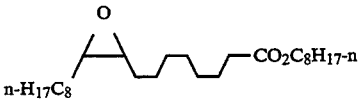

ST-13

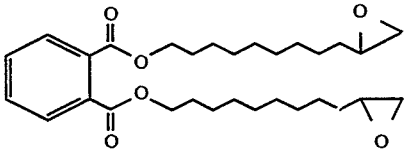

ST-14

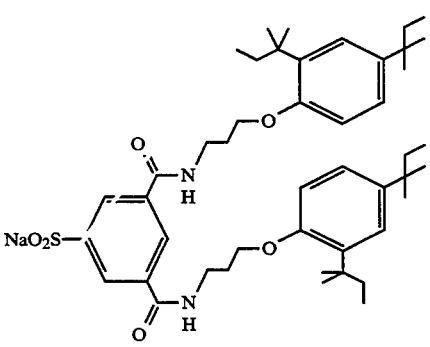

ST-15

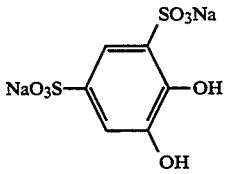

-continued

Stabilizers

ST-16

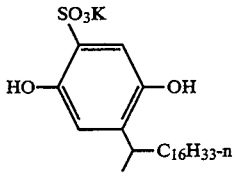

The aqueous phase of the dispersions of the photographic elements used in conjunction with elements of the invention may comprise a hydrophilic colloid. This may be gelatin or a modified gelatin such as acetylated gelatin, phthalated gelatin, oxidized gelatin, etc. The hydrophilic colloid may be another water-soluble polymer or copolymer including, but not limited to poly(vinyl alcohol), partially hydrolyzed poly(vinylacetate/-vinylalcohol), hydroxyethyl cellulose, poly(acrylic acid), poly(1-vinylpyrrolidone), poly(sodium styrene sulfonate), poly(2-acrylamido-2-methane sulfonic acid), and polyacrylamide. Copolymers of these polymers with hydrophobic monomers may also be used.

Oil components may also include high-boiling or permanent solvents. Examples of solvents which may be used include, but are not limited to, the following.

| Solvents | |
|---|---|
| Dibutyl phthalate | S-1 |
| Tritolyl phosphate | S-2 |
| N,N-Diethyldodecanamide | S-3 |
| Tris(2-ethylhexyl)phosphate | S-4 |
| 2-(2-Butoxyethoxy)ethyl acetate | S-5 |
| 2,5-Di-tert-pentylphenol | S-6 |
| Acetyl tributyl citrate | S-7 |

The dispersions used in photographic elements may also include ultraviolet (UV) stabilizers and so called liquid UV stabilizers such as described in U.S. Pat. Nos. 4,992,358; 4,975,360; and 4,587,346. Representative examples of UV stabilizers are shown below.

UV Stabilizers

UV-1

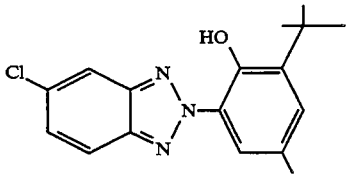

UV-2

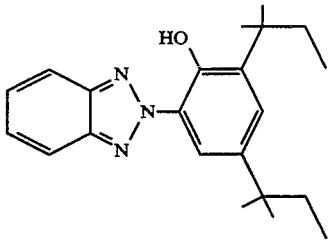

-continued

UV Stabilizers

UV-3

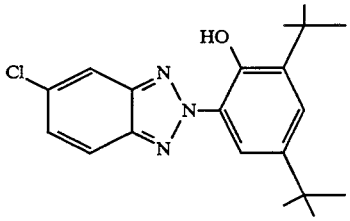

UV-4

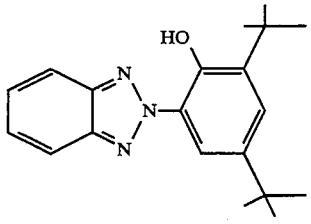

UV-5

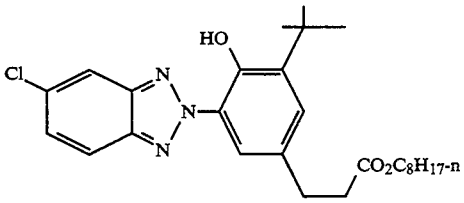

UV-6

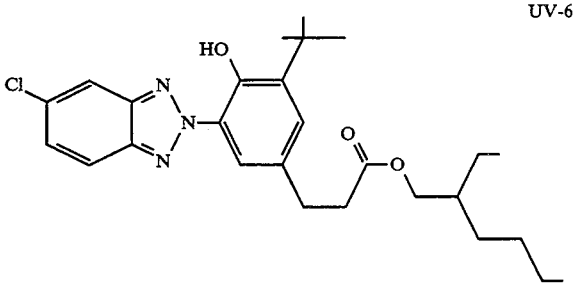

UV-7

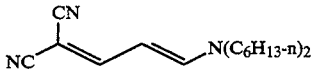

UV-8

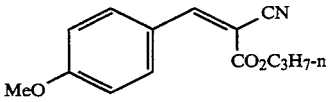

The aqueous phase may include surfactants. Surfactant may be cationic, anionic, zwitterionic or non-ionic. Useful surfactants include, but are not limited to, the following.

Surfactants

SF-1

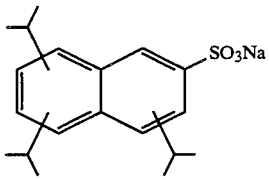

$CF_3.(CF_2)_7.SO_3Na$ SF-2

$CH_3.(CH_2)_n.SO_3Na$, n = 12–14 SF-3

-continued

Surfactants

SF-4

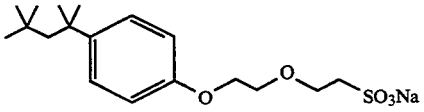

SF-5

$CH_3.(CH_2)_{11}.OSO_3Na$

SF-6

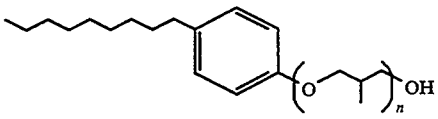

n = ca. 10

SF-7

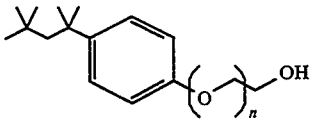

n = ca. 40

SF-8

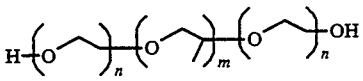

n = ca. 6, m = ca. 22

SF-9

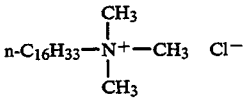

SF-10

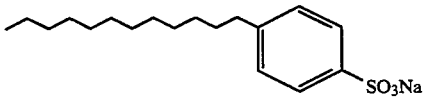

SF-11

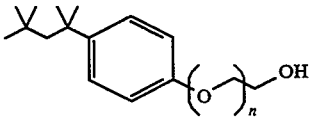

n = ca. 10

Further, it is contemplated to stabilize photographic dispersions prone to particle growth through the use of hydrophobic, photographically inert compounds such as disclosed by Zengerle et al in U.S. Ser. No. 07/978,104.

Various types of polymeric addenda could be advantageously used in conjunction with elements of the invention. Recent patents, particularly relating to color paper, have described the use of oil-soluble water-insoluble polymers in coupler dispersions to give improved image stability to light, heat and humidity, as well as other advantages, including abrasion resistance, and manufacturability of product. These are described, for instance, in EP 324,476, U.S. Pat. Nos. 4,857,449, 5,006,453, and 5,055,386. In a preferred embodiment, a yellow or cyan image coupler, permanent solvent, and a vinyl polymer with a high glass transition temperature and moderate molecular weight (ca. 40,000) are dissolved together with ethyl acetate, the solution is emulsified in an aqueous solution containing gelatin and surfactant to give fine particles, and the ethyl acetate is removed by evaporation. Preferred polymers include poly(N-t-butylacrylamide) and poly(methyl methacrylate).

Various types of hardeners are useful in photographic elements used in conjunction with elements of the invention. In particular, bis(vinylsulphonyl) methane, bis(vinylsulfonyl) methyl ether, 1,2-bis(vinylsulfonylacetamido) ethane, 2,4-dichloro-6 -hydroxy-s-triazine, triacryloyltriazine, and pyridinium, 1-(4-morpholinylcarbonyl)-4-(2-sulfoethyl)inner salt are particularly useful. Also useful are so-called fast acting hardeners as disclosed in U.S. Pat. Nos. 4,418,142, 4,618,573, 4,673,632, 4,863,841, 4,877,724, 5,009,990, 5,236,822.

The invention may be used in combination with photographic elements containing filter dye layers comprising colloidal silver sol or yellow, cyan, and/or magenta filter dyes, either as oil-in-water dispersions, latex dispersions or as solid particle dispersions. Useful examples of absorbing materials are discussed in *Research Disclosure,* December 1989, Item 308119.

The invention also may be used in combination with photographic elements containing light absorbing materials that can increase sharpness and be used to control speed. Examples of useful absorber dyes are described in U.S. Pat. No. 4,877,721, U.S. Pat. No. 5,001,043, U.S. Pat. No. 5,153,108, and U.S. Pat. No. 5,035,985. Solid particle dispersion dyes are described in U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; 5,266,454. Useful absorber dyes include, but are not limited to, the following.

Absorber Dyes

AD-1

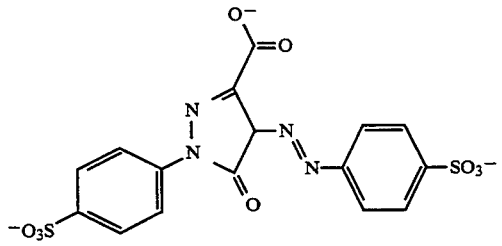

-continued

Absorber Dyes

AD-2

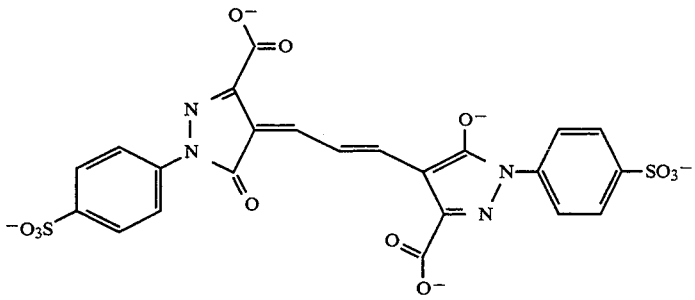

AD-3

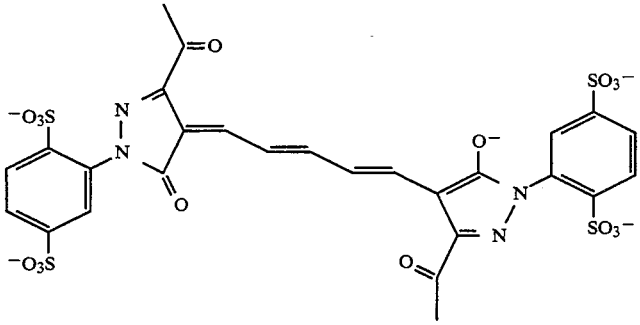

Additionally, the invention may be used with elements containing "smearing" couplers (e.g. as described in U.S. Pat. No. 4,366,237; EP 96,570; U.S. Pat. No. 4,420,556; and U.S. Pat. No. 4,543,323). Also, the compositions may be blocked or coated in protected form as described, for example, in Japanese Application 61/258,249 or U.S. Pat. No. 5,019,492.

The invention materials may further be used in combination with a photographic element containing image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

In a preferred embodiment, the inhibitor moiety or group is selected from the following formulas:

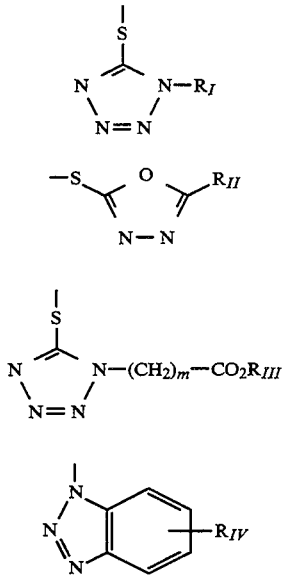

-continued

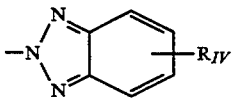

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60/249148; 60/249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57/188035; 58/98728; 58/209736; 58/209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features described above. Typical timing groups or moieties have the following formulas:

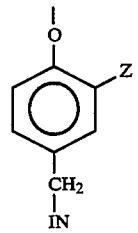

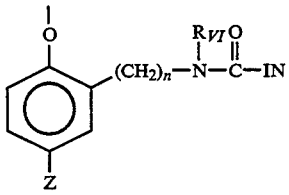

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers include, but are not limited to, the following:

D1

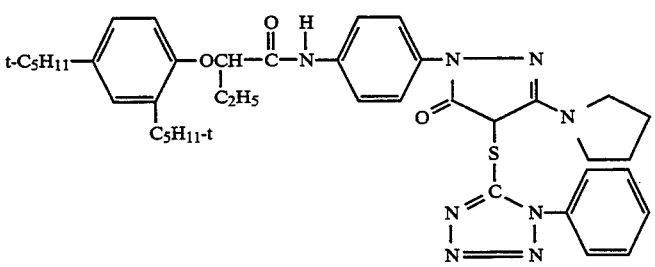

D2

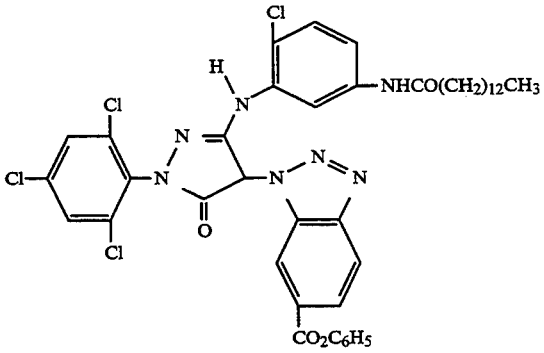

D3

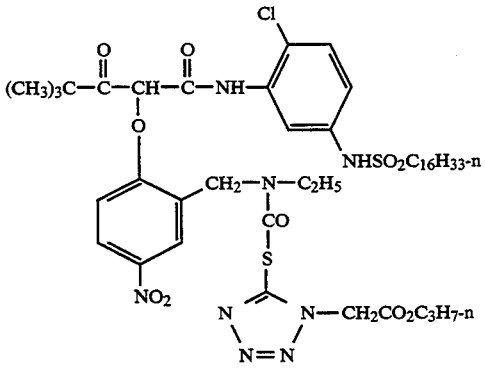

-continued

D4

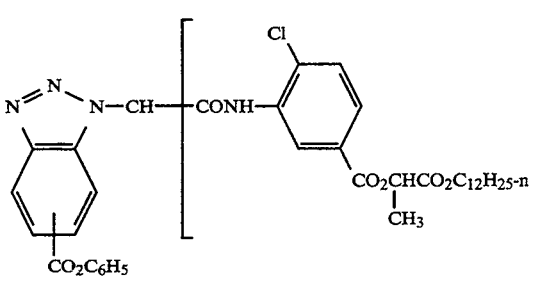

D5

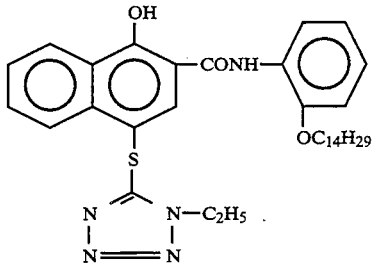

D6

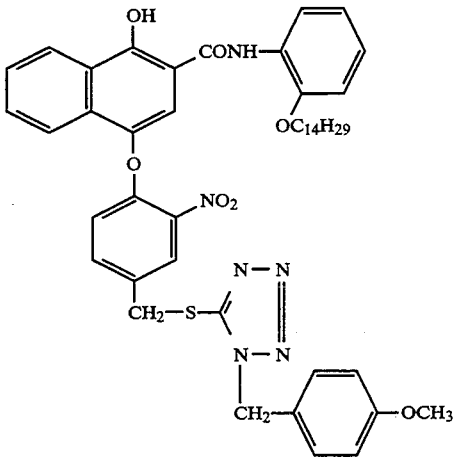

D7

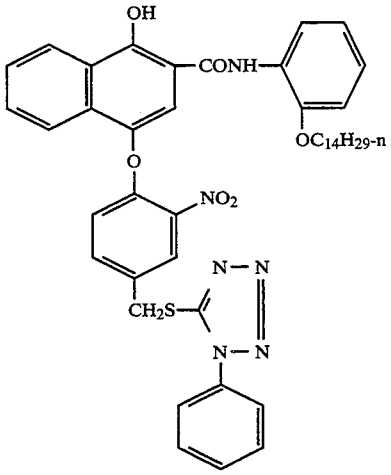

D8

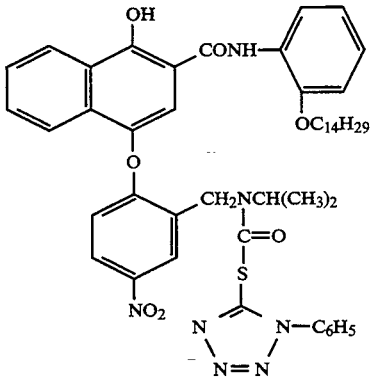

D9

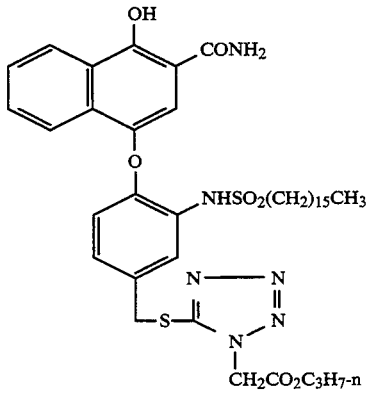

The emulsions of the photographic elements can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. The emulsions may be precipitated in any suitable environment such as a ripening envirofunent, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463, Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508, Hasebe et al U.S. Pat. No. 4,820,624; Maskasky U.S. Pat. No. 5,264,337; and Brust et al EP 534,395.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017,468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et at U.S. Pat. No. 4,035,185 and Evans et al U.S. Pat. No. 4,504,570.

Especially useful for use in conjunction with elements of this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulsions as described in EP 534,395 are specifically contemplated.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Fin, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering*, Vol. 24, No. 6 Nov./Dec. 1980, pp. 265267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, cl, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No.

4,4,828,962 (Ru+Ir, b1); Janusonis U.S. Pat. No. 4,835,093 (Re, al); Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, cl, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. Nos. 5,166,044 and 5,204,234 (Fe+Ir, a2 b, cl, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, Tl, Fe, d); Miyoshi et al EPO 0 488 737 and0 488 601 (Ir+-VIII/Sc/Ti/V/Cr/Mn/Y/Zr/Nb/Mo/La/Ta/W/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g); Budz WO 93/02390 (Au, g); Ohkubo et al U.S. Pat. No. 3,672,901 (Fe, a2, c1); Yamasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiodyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Serial No. 08/091,148. Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Tl, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold (aurous bis(1,4,5-trimethyl-1,2,4-triazolium-3-thiolate) tetrafluoroborate. Sulfur sensitizers may include thiosulfate, thiocyanate or N,N'-carbobothioyl-bis(N-methylglycine).

The addition of one or more antifoggants as stain reducing agents is also common in silver halide systems. Tetrazaindenes, such as 4-hydroxy-6-methyl(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also especially useful.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to select from among the low staining sensitizing dyes disclosed in U.S. Ser. No. 07/978,589 filed Nov. 19, 1992, and U.S. Ser. No. 07/978,568 filed Nov. 19, 1992, both granted, and European Patent Application Nos. 93/203,191.7 and 93/203,193.5. Use of low staining sensitizing dyes in a photographic element processed in a developer solution with little or no optical brightening agent (for instance, stilbene compounds such as Blankophor REU) is specifically contemplated. Further, these low staining dyes can be used in combination with other dyes known to the art (*Research Disclosure,* December 1989, Item 308119, Section IV).

Emulsions can be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response. In addition, the combination of similarly spectrally sensitized emulsions can be in one or more layers.

An important quality characteristic of color paper is color reproduction, which represents how accurately the hues of the original scene are reproduced. Many current color papers use a blue sensitizing dye that gives a maximum sensitivity at about 480 nm. Use of a sensitizing dye that affords a sensitivity maximum that is closer to that of the yellow image dye in film, for instance with a sensitivity maximum of around 450–470 nm, can result in a color paper with improved color reproduction.

If desired, the photographic element can be used in conjunction with an applied magenetic recording layer as described in *Research Disclosure,* November 992, Item 34390.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be used in combination with a photographic element that contains epoxy solvents (EP 64,961); ballasted chelating agents such as those in U.S. Pat. No. 4,994,359 to reduce sensitivity to polyvalent cations such as calcium; and stain reducing compounds such as described in U.S. Pat. Nos. 5,068,171, 5,096,805, and 5,126,234. Other useful embodiments are disclosed in Japanese Published Applications: 2/027,344; 02/027,345; 02/027,347; 02/027,350; 2/027,351; 02/028,646; 02/029,738; 02/029,739; 2/032,340; 02/032,342; 02/033,143; 02/033,144; 2/034,836; 02/034,838; 02/034,839; 02/034,840; 2/034,841; 02/034,842; 02/034,843; 02/037,343; 2/039,046; 02/039,047; 02/040,650; 02/040,651; 2/040,652; 02/040,653; 02/042,438; 02/042,439; 2/043,540; 02/043,542; 02/043,544; 02/043,545; 2/043,547; 02/044,341; 02/044,342; 02/054,262; 2/096,136; 02/139,545.

Any suitable base material may be utilized for the color paper to be used with elements of the invention. Typically, base materials are formed of paper or polyester. The paper may be resin-coated. Further, the paper base material may be coated with reflective materials that will make the image appear brighter to the viewer such as polyethylene impregnated with titanium dioxide. In addition, the paper or resins may contain stabilizers, tints, stiffeners or oxygen barrier providing materials such as polyvinyl alcohol (PVA, for example, see EP 553,339). In addition, it may be desired to use the invention in conjunction with a photographic element coated on pH adjusted support as described in U.S. Pat. No. 4,917,994. The particular base material utilized in the invention may be any material conventionally used in silver halide color papers. Such materials are disclosed in *Research Disclosure* 308119, December 1989, page 1009. Additionally materials like polyethylene naphthalate and the materials described in U.S. Pat. Nos. 4,770,931; 4,942,005; and 5,156,905 may be used.

The color paper used in conjunction with elements of the invention may use any conventional peptizer material. A typical material utilized in color paper as a peptizer and carrier is gelatin. Such gelatin may be any of the conventional utilized gelatins for color paper. Preferred are the ossein gelatins. The color papers further may contain materials such as typically utilized in color papers including biostats, such as described in U.S. Pat. No. 4,490,462, fungicides, stabilizers, inter layers, overcoat protective layers.

In a color negative element, it is contemplated to use the invention in conjunction with a photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1 -imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis (1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]-phenyl]thio]-1,3,4-thiadiazol-2-yl]thio]-, methyl ester and "Coupler 3": 1-((dodecyloxy)carbonyl)ethyl (3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H -pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl-)amino) carbonyl)-4-hydroxy-8-(((2-methylpropoxy)-carbonyl) amino)-1-naphthalenyl)oxy)ethyl)thio)-, and "Coupler 8" Benzamide, 3-((2-(2,4-bis(1,1-dimethylpropyl)phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)-phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino)carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, it is contemplated to use the invention in conjunction with an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2"": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)-; and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]-together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)-1-oxobutyl)amino)-2-chlorophenyl)-α-(2,2-dimethyl-1-oxopropyl)-4-ethoxy-2,5-dioxo-3-(phenylmethyl)-.

In a reversal format, it is contemplated to use the invention in conjunction with an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with fast and mid magenta layers containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino) -N-(4,5-dihydro-5-oxo-1-(2,4,6-trichlorophenyl)-1H -pyrazol-3-yl)-; and "Coupler 5": Benzamide, 3-(((2,4 -bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with fast, mid, and slow cyan layers containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)-phenoxy) -N-(4-((2,2,3,3,4,4,4-heptafluoro-1-oxobutyl-)amino)-3-hydroxyphenyl)-;

(10) one or more interlayers possibly including fine-grained nonsensitized silver halide; and

(11) an antihalation layer.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes, such as the RA-4 process of Eastman Kodak Company as described in the British Journal of Photography Annual of 1988, pages 198–199, the Kodak Ektaprint 2 Process as described in Kodak Publication No. Z-122, using Kodak Ektaprint chemicals, and the Kodak ECP Process as described in Kodak Publication No. H-24, Manual For Processing Eastman Color Films. To provide a positive (or reversal) image, the color development step can be preceded by development with a non-chromogenic developing agent to develop exposed silver halide, but not form dye, and followed by uniformly fogging the element to render unexposed silver halide developable.

In these color photographic systems, the color-forming coupler is incorporated in the developer or the light-sensitive photographic emulsion layer so that during development, it is available in the emulsion layer to react with the color developing agent that is oxidized by silver image development. Diffusible couplers are used in color developer solutions. Non-diffusing couplers are incorporated in photographic emulsion layers. When the dye image formed is to be used in situ, couplers are selected which form non-diffusing dyes. For image-transfer color processes, couplers are used which will produce diffusible dyes capable of being mordanted or fixed in the receiving sheet. The color-photographic systems described can also be used to produce black-and-white images from non-diffusing couplers as described by Edwards et al in International Publication No. WO 93/012465.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, issued May 26, 1981, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development (for color reversal light-sensitive materials, black-and-white first development is necessary) and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used with this invention may be liquids, pastes, or solids, such as powders, tablets or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

Color Paper Process

The following processing steps may be included in the preferable processing steps carried out in the method in which a processing solution is applied:

1) Color developing→bleach-fixing→washing/stabilizing;

2) Color developing→bleaching→fixing→washing/-stabilizing;

3) Color developing→bleaching→bleach-fixing-→washing/stabilizing;

4). Color developing→stopping→washing→bleaching→washing→fixing→washing/stabilizing;

5) Color developing→bleach-fixing→fixing→washing/stabilizing;

6) Color developing→bleaching→bleach-fixing→fixing→washing/stabilizing.

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this invention may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluenesulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present invention:

4-amino-3-methyl-N-ethyl-N-(β-hydroxyethyl)aniline sulfate, 4-amino-3-methyl-N-ethyl-N-(β-(methanesulfonamido) ethyl)aniline sesquisulfate hydrate, 4-amino-N,N-diethylaniline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, the first two may preferably be used. There may be some instances where the above mentioned color developing agents may be used in combination so that they meet the purposes of the application.

The color developing agent is generally employed in concentrations of from 0.0002 to 0.2 mole per liter of developing solution and more preferably from about 0,001 to 0.05 mole per liter of developing solution.

The developing solution should also contain chloride ions in the range 0.006 to 0.33 mole per liter, preferably 0.02 to 0.16 moles per liter and bromide ions in the range of zero to 0.001 mole per liter, preferably $2\times10^{-5}$ to $5\times10^{-4}$ mole per liter. The chloride ions and bromide ions may be added directly to the developer or they may be allowed to dissolve out from the photographic material in the developer and may be supplied from the emulsion or a source other than the emulsion.

If chloride is added directly to the color developer, the chloride-ion-supplying salt can be (although not limited to) sodium chloride, potassium chloride, ammonium chloride, lithium chloride, magnesium chloride, manganese chloride, and calcium chloride, with sodium chloride and potassium chloride preferred.

If bromide is added directly to the color developer, the bromide-ion-supplying salt can be (although not limited to) sodium bromide, potassium bromide, ammonium bromide, lithium bromide, calcium bromide, and manganese bromide, with sodium bromide and potassium bromide preferred.

The chloride-ions and bromide-ions may be supplied as a counter ion for another component of the developer, for example the counter ion for a stain reducing agent.

Preferably, the pH of the color developer is in the range of 9 to 12, more preferably 9.6 to 11.0 and it can contain other known components of a conventional developing solution.

To maintain the above-mentioned pH, it is preferable to use various buffer agents. Examples of buffer agents that can be mentioned include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). Preferably the amount of buffer agent to be added is 0.1 mole per liter to 0.4 mole per liter.

Additional components of the developer include preservatives to protect the color developing agent from decomposition. The 'preservative' is characterized as a compound that generally can reduce the rate of decomposition of the color developing agent. When it is added to the processing solution for the color photographic material it prevents the oxidation of the color developing agent caused by oxygen in the air. It is preferable that the developer used in conjunction with the present invention contain an organic preservative. Particular examples include hydroxylamine derivatives (but excluding hydroxylamine, as described later), hydrazines, hydrazides, hydroxamic acids, phenols, aminoketones, sacharides, monoamines, diamines, polyamines, quaternary ammonium salts, nitroxy radicals, alcohols, oximes, diamide compounds, and condensed ring-type amines.

For the preferable organic preservatives mentioned above, typical compounds are mentioned below. It is desirable that the amount of the compounds mentioned below be added to the developer solution at a concentration of 0.005 to 0.5 mole per liter, and preferably 0.025 to 0.1 mole per liter.

As hydroxylamine derivatives, the following are preferable:

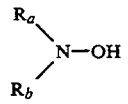

Formula (I)

where $R_a$ and $R_b$ each represent a hydrogen atom, a substituted or unsubstituted alkyl group, a substituted or unsubstituted alkenyl group, a substituted or unsubstituted aryl group, a substituted or unsubstituted heteroaromatic group, they do not represent hydrogen atoms at the same time, and they may bond together to form a heterocyclic ring with the nitrogen atom. The ring structure of the heterocyclic ring is a 5–6 member ring, it is made up of carbon atoms, oxygen atoms, nitrogen atoms, sulfur atoms, etc. and it may be saturated or unsaturated.

It is preferable that $R_a$ and $R_b$ each represent an alkyl group or an alkenyl group having 1 to 5 carbon atoms. As nitrogen containing heterocyclic rings formed by bonding $R_a$ and $R_b$ together examples are a piperidyl group, a pyrolidyl group, an N-alkylpiperazyl group, a morpholyl group, an indolinyl group, and a benzotriazole group.

Preferable substituents of $R_a$ and $R_b$ are a hydroxyl group, an alkoxy group, an alkylsulfonyl group, an arylsulfonyl group, an amido group, a carboxyl group, a sulfo group, a nitro group, and an amino group. Exemplified compounds are:

I-1

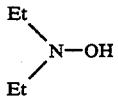

I-2

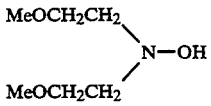

I-3

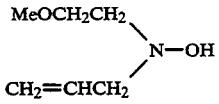

I-4

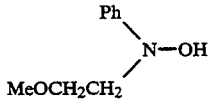

I-5

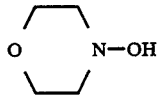

I-6

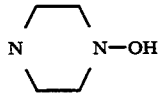

I-7

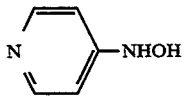

I-8

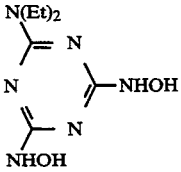

The hydrazines and hydrazides preferably include those represented by the formula II:

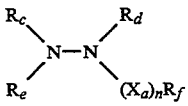

Formula (II)

where $R_c$, $R_d$, and $R_e$, which may be the same or different, represents a hydrogen atom, a substituted or unsubstituted alkyl group, a substituted or unsubstituted aryl group, a substituted or unsubstituted heterocyclic group; Rf represents a hydroxyl group, a hydroxylamino group, a substituted or unsubstituted alkyl group, a substituted or unsubstituted aryl group, a substituted or unsubstituted amino group, a substituted or unsubstituted alkoxyl group, a substituted or unsubstituted aryloxy group, a substituted to unsubstituted carbamoyl group, or a substituted or unsubstituted saturated or unsaturated 5- or 6-member heterocyclic group comprising carbon, oxygen, nitrogen, sulfur atoms, etc.; $X_a$ represents a divalent group selected from —CO—, —$SO_2$— and >C=NH and n represents 0 or 1; provided that when n is 0, $R_f$ is selected from an alkyl group, an aryl group, and a heterocyclic group; $R_d$ and $R_e$ may combine to form a heterocylic group.

In formula (II) $R_c$, $R_d$, $R_f$ each preferably represents a hydrogen atom or an alkyl group having from 1 to 10 carbon atoms. $R_c$ and $R_d$ each more preferably represent a hydrogen atom.

$R_f$ preferably represents an alkyl group, an aryl group, an alkoxyl group, a carbamoyl group, or an amino group, and more preferably an alkyl group or a substituted alkyl group. Preferred substituents on the alkyl group include a carboxyl group, a sulfo group, a nitro group, an amino group, a phosphono group, etc. $X_a$ preferably represents —CO— or —$SO_2$—, and most preferably represents —CO—.

Specific examples of the hydrazines and hydrazides represented by formula (II) are shown below.

II-1

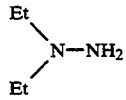

II-2

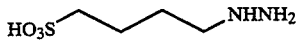

II-3

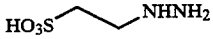

II-4

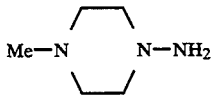

II-5

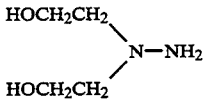

II-6

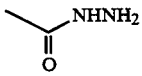

II-7

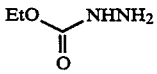

II-8

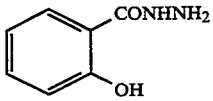

II-9

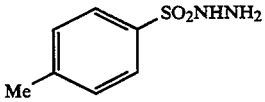

II-10

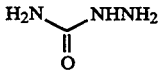

-continued

II-11

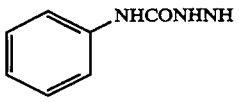

II-12

$HO_3S{=}NHNH_2$

II-13

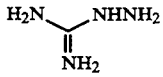

II-14

$NH_2NHCOCONHNH_2$

II-15

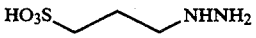

II-16

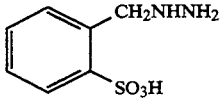

II-17

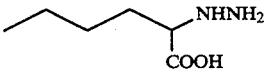

II-18

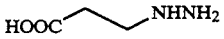

II-19

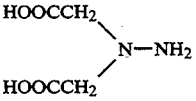

II-20

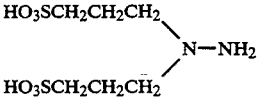

II-21

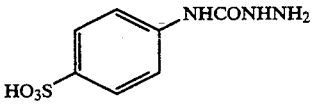

II-22

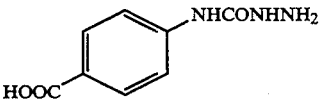

Other organic preservatives of potential use are mentioned by Yoshida, et. al., in U.S. Pat. No. 5,077,180 with lists of examples from each of the classes for the following organic preservative classes: hydroxamic acids, phenols, aminoketones, sacharides, monoamines, diamines, polyamines, quaternary ammonium salts, nitroxy radicals, alcohols, oximes, diamide compounds, and condensed ring-type amines. Additionally, a sulfinic acid or salt thereof may be used to improve the stability of the color developing agent in concentrated solutions, with examples described by Nakamura, et. al., in U.S. Pat. No. 5,204,229.

A further ingredient which can optionally be included in the color developing composition to improve the stability of the color developer and assure stable continuous processing represented by formula (III):

Formula (III)

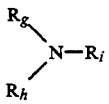

where $R_g$, $R_h$, and $R_i$ each represents a hydrogen atom, a substituted or unsubstituted alkyl group, a substituted or unsubstituted alkenyl group, a substituted or unsubstituted aryl group, a substituted or unsubstituted aralkyl group, or a substituted or unsubstituted heterocyclic group; or $R_g$ and $R_h$, $R_g$ and $R_i$, or $R_h$ and $R_i$ may combine to form a nitrogen-containing heterocyclic ring. As described in Case et. al. U.S. Pat. No. 4,170,478 a preferred example of formula (III) are alkanolamines, wherein $R_g$ is an hydroxyalkyl group and each of $R_h$ and $R_i$ is a hydrogen atom, an alkyl group, a hydroxyalkyl group, an aryl group, or a $—C_nH_{2n}N(Y)Z$ group wherein n is an integer of from 1 to 6 and each of Y and Z is a hydrogen atom, an alkyl group or an hydroxylalkyl group.

Specific examples of the amine and hydroxylamine compounds represented by formula (III) are shown below.

III-1

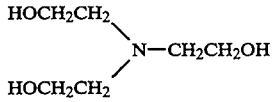

III-2

$H_2NCH_2CH_2OH$

III-3

$HOCH_2CH_2—NH—CH_2CH_2OH$

III-4

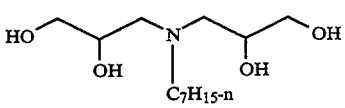

III-5

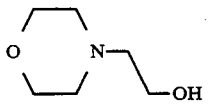

III-6

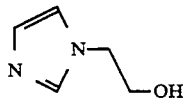

III-7

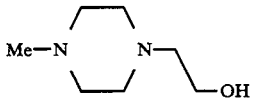

III-8

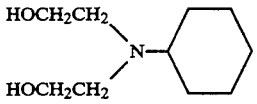

III-9

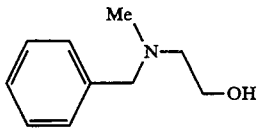

III-10

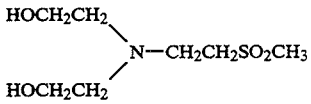

III-11

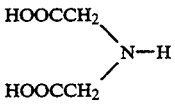

-continued

III-12

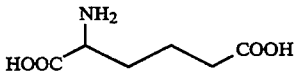

III-13

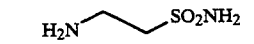

III-14

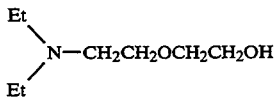

III-15

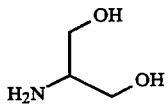

III-16

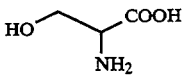

III-17

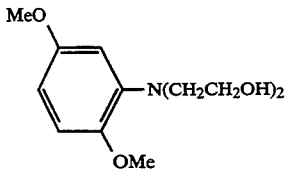

III-18

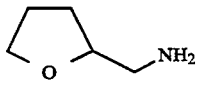

III-19

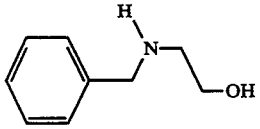

III-20

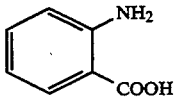

A small amount of sulfite can optionally be incorporated in the developing compositions to provide additional protection against oxidation. In view of the fact that sulfite competes in the developer with coupler for oxidized developing agent and can have a resultant effect to decrease the desired image dye formation, it is preferred that the amount of sulfite be very small, for example in the range from zero to 0.04 moles per liter. The use of a small amount of sulfite is especially desirable when the color developing composition is packaged in a concentrated form to preserve the concentrated solution from oxidation.

It is preferable that the developer is substantially free of hydroxylamine, often used as a developer preservative. This is because hydroxylamine has an undesired effect on the silver development and results in low yields of image dye formation. The expression 'substantially-free from hydroxylamine' means that the developer contains only 0.005 moles per liter or below of hydroxylamine per liter of developer solution.

To improve the clarity of the working developer solution and reduce the tendency for tarring to take place it is preferred to incorporate therein a water-soluble sulfonated polystyrene. The sulfonated polystyrene can be used in the free acid form or in the salt form. The free acid form of the sulfonated polystyrene is comprised of units having the formula:

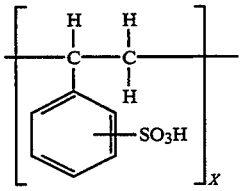

where X is an integer representing the number of repeating units in the polymer chain and is typically in the range from about 10 to about 3,000 and more preferably in the range from about 100 to 1,000.

The salt form of the sulfonated polystyrene is comprised of units having the formula:

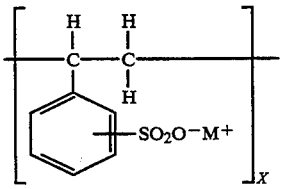

where X is as defined above and M is a monovalent cation, such as, for example, an alkali metal ion.

The sulfonated polystyrenes utilized in the developing compositions can be substituted with substituents such as halogen atoms, hydroxy groups, and substituted or unsubstituted alkyl groups. For example, they can be sulfonated derivatives of chlorostyrene, alpha-methyl styrene, vinyl toldene, and the like. Neither the molecular weight nor the degree of sulfonation are critical, except that the molecular weight should not be so high nor the degree of sulfonation so low as to render the sulfonated polystyrene insoluble in aqueous alkaline photographic color developing solutions. Typically, the average degree of sulfonation, that is the number of sulfonic acid groups per repeating styrene unit, is in the range from about 0.5 to 4 and more preferably in the range from about 1 to 2.5. A variety of salts of the sulfonated polystyrene can be employed, including, in addition to alkali metal salts, the amine salts such as salts of monoethanolamine, diethanolamine, triethanolamine, morpholine, pyridine, picoline, quinoline, and the like.

The sulfonated polystyrene can be used in the working developer solution in any effective amount. Typically, it is employed in amount of from about 0.05 to about 30 grams per liter of developer solution, more usually in amount of from about 0.1 to about 15 grams per liter, and preferably in amounts of from 0.2 to about 5 grams per liter.

In addition various chelating agents may also be added to the developer to prevent calcium or magnesium from precipitating or to improve the stability of the color developer. Specific examples are shown below, but use with the present invention is not limited to them:

nitrilotriacetic acid,
diethylenetriaminepentaacetic acid,
ethylenediaminetetraacetic acid,
triethylenetetraaminehexaaacetic acid,
N,N,N-trimethylenephosphonic acid, ethylenediamine-N,N,N',N'-tetramethylenephosphonic acid,
1,3-diamino-2-propanoltetraacetic acid,
trans-cyclohexanediaminetetraacetic acid,
nitrilotripropionic acid,
1,2-diaminopropanetetraacetic acid,
hydroxyethyliminodiacetic acid,
glycol ether diaminetetraacetic acid,
hydroxyethylenediaminetriacetic acid,
ethylenediamine-o-hydroxyphenylacetic acid,
2-phosphonobutane-1,2,4-tricarboxylic acid,
1-hydroxyethylidene-1,1-diphosphonic acid,
N,N'-bis(2-hydroxybenzyl)ethylenediamine-N,N'-diacetate,
N-N'-bis(2-hydroxybenzyl)ethylenediamine-N,N'-diacetic acid,
catechol-3,4,6-trisulfonic acid,
catechol-3,5-disulfonic acid,
5-sulfosalycylic acid,
4-sulfosalicylic acid,
β-ataninediacetic acid,
and glycinedipropionic acid.

A particularly useful chelating agent for photographic color developer compositions are the hydroxyalkylidene diphosphonic acid of the formula:

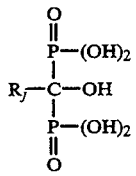

Formula (IV)

where Rj is an alkyl or substituted alkyl group. When Rj is an ethyl group a preferred chelating agent example, is 1-hydroxyethylidene-1,1-diphosphonic acid. The hydroxyalkylidene diphosphonic acid chelating agents can serve as both the chelating agent which functions to sequester iron and which functions to sequester calcium, as they have the ability to effectively sequester both iron and calcium. As described in Brown, U.S. Pat. No. 3,839,045, they are preferably utilized in combination with small amounts of lithium salts, such as lithium sulfate or lithium chloride.

The chelating agents can be utilized in the form of a free acid or in the form of a water soluble salt form. If desired, the above mentioned chelating agents may be used as a combination of two or more. One preferred combination is demonstrated by Buongiorne, et. al., U.S. Pat. No. 4,975,357 as a combination of the class of polyhydroxy compounds, such as catechol-3,5-disulfonic acid, and of the class of an aminocarboxylic acid, such as ethylenetriamine pentaacetic acid.

It is preferable that the color developer be substantially free of benzyl alcohol. Herein the term 'substantially free of benzyl alcohol' means that the amount of benzyl alcohol is no more than 2 milliliters per liter, but even more preferably benzyl alcohol should not be contained at all.

It is preferred that the color developer contain a triazinyl stilbene type stain reducing agent, which is often referred to as a fluorescent whitening agent. There are a wide variety of effective stain reducing agents, preferred examples include Blankophor REU, and Tinopal SFP. The triazinyl stilbene type of stain reducing agent may be used in an amount within the range of, preferably 0.2 grams to 10 grams per liter of developer solution and more preferably, 0.4 to 5 grams per liter.

In addition, compounds can be added to the color developing solution to increase the solubility of the developing agent. Examples of materials, if required, include methyl cellosolve, methanol, acetone, dimethyl formamide, cyclodextrin, dimethyl formamide, diethylene glycol, and ethylene glycol.

It is also mentioned that the color developer solution may contain an auxiliary developing agent together with the color developing agent. Examples of known auxiliary developing agents include for example, N-methyl-p-aminophenol sulfate, phenidone, N,N-diethyl -p-aminophenol hydrochloride and an N,N,N'N'-tetramethyl-p-phenylenediamine hydrochloride. The auxiliary developing agent may be added in an amount within the range of, typically, 0.01 to 1.0 grams per liter of color developer solution.

It may be preferable, if required to enhance the effects of the color developer, to include an anionic, cationic, amphoteric and nonionic surfactant. If necessary, various other components may be added to the color developer solution, including dye-forming couplers, competitive couplers, and fogging agents such as sodium borohydride.

If desired, the color developing agent may contain an appropriate development accelerator. Examples of development accelerators include thioether compound as described in U.S. Pat. No. 3,813,247; quaternary ammonium salts; the amine compounds as described in U.S. Pat. Nos. 2,494,903, 3,128,182, 3,253,919, and 4,230,796; the polyalkylene oxides as described in U.S. Pat. No. 3,532,501.

An antifoggant may be added if required. Antifoggants that can be added include alkali metal halides, such as sodium or potassium chloride, sodium or potassium bromide, sodium or potassium iodide and organic antifoggants. Representative examples of organic antifoggants include nitrogen-containing heterocyclic compounds such as benzotriazole, 6-nitrobenzimidazole, 5-nitrobenzotriazole, 5-chlorobenzotriazole, 2-thiazolylbenzimidazole, 2-thiazolylmethylbenzimidazole, indazoles, hydroxyazindolizine, and adenine.

The above mentioned color developer solutions may be used at a processing temperature of preferably 25° C. to 45° C. and more preferably from 35° C. to 45° C. Further, the color developer solution may be used with a processing time in the developer step of the process with a time of not longer than 240 seconds and preferably within a range from 3 seconds to 110 seconds, and more preferably not shorter than 5 seconds and not longer than 45 seconds.

As previously described, a color developer processing tank in a continuous processor is replenished with a replenisher solution to maintain the correct concentration of color developer solution components. The color developer replenisher solution may be replenished in an amount of, ordinarily not more than 500 milliliters per square meter of a light sensitive material. Since replenishment results in a quantity of waste solution, the rate of replenishment is preferably minimized so that waste volume and costs can be minimized. A preferred replenishment rate is within a range of 10 to 215 milliliters per square meter, and more preferably 25 to 160 milliliters per square meter.

Additionally the developer waste volume and material costs may be reduced by recovering the overflow from the developer tank as it is being replenished and treating the overflow solution in a manner so that the overflow solution can be used again as a replenisher solution. In one operating mode, chemicals are added to the overflow solution to make up for the loss of chemicals from that tank solution that resulted from the consumption of chemicals that occurred during the development reactions. The chemicals can be added as solid components or a aqueous solutions of the component chemicals. Addition of water and the aqueous solutions of the make-up chemicals also have the effect to reduce the concentration of the materials that wash out of the light-sensitive material and are present in the developer overflow. This dilution of materials that wash out of the light-sensitive material prevents concentration of these materials from increasing to concentrations that can lead to undesired photographic effects, reduced solution stability, and precipitates. The method for the regeneration of a developer is described in Kodak Publication No. Z-130, 'Using EKTACOLOR RA Chemicals'. If the materials that wash out of the light-sensitive material are found to increase to an objectionable concentration, the overflow solution can be treated to remove the objectionable material. Ion-exchange resins, cationic, anionic and amphoteric are especially well suited to remove specific components found to be objectionable.

The recovery of developer solution overflow can be characterized as the percentage of the original replenisher solution that is recovered and reused, thus a 55% 'reuse ratio' indicates that of the original replenisher volume used, 55% of the original volume was recovered and reused. A packaged chemical mix of concentrated chemical solutions concentrates can be designed to be used with a designated amount of overflow to produce a replenisher solution for use in the continuous processor being used to process the light sensitive material. While it is useful to be able to recover any amount of developer overflow solution, it is preferable to be able to recover at least 50% (ie. a 50% reuse ratio) of the developer overflow. It is preferred to have a reuse ratio of 50% to 75% and it is more preferred to have a reuse ratio of 50% to 95%.

It is an objective for use with the current invention to produce a color photographic light sensitive material where substantially all of the silver that was originally used in producing the photographic images is removed from the light-sensitive material during the processing stage. In a preferred example, both the developed and undeveloped silver is removed in a single processing step using a bleach-fix solution.

The components of a bleach-fix solution are comprised of silver halide solvents, preservatives, bleaching agents, chelating agents, acids, and bases. Each of the components may be used as single components or as mixtures of two or more components.

As silver solvents, thiosulfates, thiocyanates, thioether compounds, thioureas, and thioglycolic acid can be used. A preferred component is thiosulfate, and ammonium thiosulfate, in particular is used most commonly owing to the high solubility. If desired, other counter ions may be used in place of ammonium ion. Alternative counter-ions such as potassium, sodium, lithium, cesium as well as mixtures of two or more cations are mentioned and would have advantages to be able to eliminate ammonia from the waste volume. The concentration of these silver halide solvents is preferably between 0.1 and 3.0 moles per liter and more preferably between 0.2 and 1.5 mole per liter.

As preservatives sulfites, bisulfites, metabisulfites, ascorbic acid, carbonyl-bisulfite adducts or sulfinic acid compounds are typically used. The use of sulfites, bisulfites, and metabisulfites are especially desirable. The concentration of preservatives is preferably present from zero to 0.5 moles per liter and more preferably between 0.02 and 0.4 moles per liter.

The use of a ferric complex salt of an organic acid is preferred for the bleaching agent and the use of ferric complex salts of aminopolycarboxylic acids is especially desirable. Examples of these aminopolycarboxylic acids are indicated below, but are not limited only to those listed.

| | |
|---|---|
| Ethylenediaminetetraacetic acid | V-1 |
| Diethylenetriaminepentaacetic acid | V-2 |
| Cyclohexanediaminetetraacetic acid | V-3 |
| 1,2-Propylenediaminetetraacetic acid | V-4 |
| Ethylenediamine-N-(β-oxyethylene)-N,N',N'-triacetic acid | V-5 |
| 1,3-Propylenediaminetetraacetic acid | V-6 |
| 1,4-diaminobutanetetraacetic acid | V-7 |
| Glycol ether diaminetetraacetic acid | V-8 |
| Iminodiacetic acid | V-9 |
| N-Methyliminodiacetic acid | V-10 |
| Ethylenediaminetetrapropionic acid | V-11 |
| (2-Acetamindo)iminodiacetic acid | V-12 |
| Dihydroxyethylglycine | V-13 |
| Ethylenediaminedi-o-hydroxyphenylacetic acid | V-14 |
| Nitrilodiacetomonopropionic acid | V-15 |
| Glycinedipropropionic acid | V-16 |
| Ethylenediaminedisuccinic acid | V-17 |
| N,N-Dicarboxyanthranilic acid | V-18 |
| Nitrilotriacetic acid | V-19 |
| β-alaninediacetic acid | V-20 |

Compounds V-1, V-2, V-3 and V-6 are preferred among the listed compounds. If desired, a combination of two or more of the aminopolycarboxylic acid may be used. Preferably the ferric complex salt may be used with a concentration between 0.01 to 1.0 mole per liter and more preferably between 0.05 and 0.5 mole per liter. Also useful are ternary ferric-complex salts formed by a tetradentate ligand and a tridentate ligand. In a preferred embodiment the tridentate ligand is represented by Formula I and the tetradentate ligand is represented by Formula II

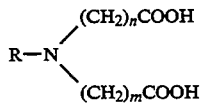

(I)

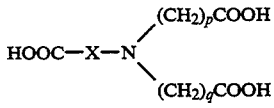

(II)

wherein R is H or an alkyl group;

m,n,p and q are 1, 2, or 3; and

X is a linking group. These are further described in U.S. application Ser. No. 08/128,626, filed Sep. 28, 1993.

If desired, additional chelating agents may be present in the bleach-fix solution to maintain the solubility of the ferric complex salt. Aminopolycarboxylic acids are generally used as chelating agents. The chelating agent may be the same as the organic acid in use with the ferric complex salt, or it may be a different organic acid.

Examples of these complexing agents are compounds V-1 to V-20, as shown above, but are not to be construed as limited only to those listed. Among these, V-1, V-2, V-3, and V-6 are preferred. These may be added in the free form or in the form of alkali metal salts or ammonium salts. The amount added to the bleach-fix solution is preferably 0.01 to 0.1 mole per liter and more preferably between 0.005 and 0.05 mole per liter.

The pH value of the bleach-fix solution is preferably in the range of about 3.0 to 8.0 and most preferably in the range of about 4.0 to 6.5. In order to adjust the pH value to the above mentioned range and to maintain good pH control, a weak organic acid with a pKa between 4 and 6, such as acetic acid, glycolic acid or malonic acid can be added in conjunction with an alkaline agent such as aqueous ammonia. The buffering acid helps maintain consistence performance of the bleaching reaction.

In addition, mineral acids such as hydrochloric acid, nitric acid, sulfuric acid and phosphoric acid can normally be used for the acid component and these acids can be used as a mixture with one or more salt of the weak acids previously mentioned above in order to provide a buffering effect.

Furthermore, halides (halogenating agents) may be added to the bleach-fix, if desired, halides include bromides, such as potassium bromide, sodium bromide, or ammonium bromide; or chlorides, such as potassium chloride, sodium bromide, or ammonium bromide.

Bleaching accelerators, brightening agents, defoaming agents, surfactants, fungicides, anticorrosion agents and organic solvents, such as polyvinylpyrrolidone or methanol, as examples, may be added, if desired.

The bleach-fix replenisher solution can be directly replenished to the bleach-fix solution to maintain chemical concentrations and pH conditions adequate to completely remove the silver from the photographic light-sensitive material. The volume of replenishment solution added per square meter of photographic light-sensitive material can be considered to be a function of the amount of silver present in the photographic light-sensitive material. It is preferred to use low volumes of replenishment solution so low silver materials are preferred. Also, bleach-fix overflow can be reconstituted as described in U.S. Pat. No. No. 5,063,142 and European Patent Application No. 410,354 or in Long et. al., U.S. Pat. No. 5,055,382.

The bleach-fix time may be about 10 to 240 seconds, with 40 to 60 seconds being a preferred range, and between 25 and 45 seconds being most preferred. The temperature of the bleach-fix solution may be in the range from 20° to 50° C. with a preferred range between 25° and 40° C. and a most preferred range between 35° and 40° C.

To minimize the volume of bleach-fix solution that is needed to process the light-sensitive photographic material, the bleach-fix solution can be recovered and treated to remove the silver from the solution by means of electrolysis, precipitation and filtration, metallic replacement with another metal, or ion-exchange treatment with a material that will remove the silver. The desilvered solution can then be reconstituted to return the chemical concentrations to the replenisher concentration to make up for the chemicals consumed during the bleach-fixing of the light-sensitive photographic material or during the silver recovery treatment process, or to compensate for the dilution of the constituents caused by the carryover of solution from the previous processing stage in the process. The degree of recovery of bleach-fix solution can be measured by comparing the volume of solution that can be recovered and reused as a percentage of the original volume that was used in the process. Thus a 90% reuse recovery ratio would occur when from an original 100 liters of replenisher volume 90 liters would be treated and recovered to produce 100 liters of regenerated fixer replenisher. The recovery reuse ratio of greater than 50% is preferred, greater than 75% is more preferred and greater than 90% is most preferred.

When an alternative process sequence is desired, separate solutions may be used for the bleaching and fixing steps. For the bleaching step, the use of a ferric complex salt of cyanide, halides, or an organic acid may be employed as the bleaching agent. The use of ferric complex salts of aminopolycarboxylic acids have been especially desirable. Examples of these complexing agents are compounds V-1 to V-20, as shown above, but are not limited only to those listed. Among these, Nos. V-1, V-2, V-3, and V-6 are preferred. If desired a combination of two or more of the aminopolycarboxylic acids may be used. Preferably the ferric complex salt may be used with a concentration between 0.01 to 1.0 mole per liter and more preferably between 0.05 and 0.5 mole per liter.

If desired, additional chelating agents may be present in the bleach solution to maintain the solubility of the ferric complex salt. Aminopolycarboxylic acids are generally used as chelating agents. The chelating agent may be the same as the organic acid in use with the ferric complex salt, or it may be a different organic acid, Examples of these complexing agents are V-1 to V-20; however, use with elements of the present invention is not to be construed as being limited only to those listed. Among these, V-1, V-2, V-3, and V-6 are preferred. These may be added in the free acid form or in the form of alkali metal salts, such as sodium, or potassium, or ammonium or tetraalkylammonium salts. It may be preferable to use alkali metal cations to avoid the aquatic toxicity associated with ammonium ion. The amount of the ferric complex salt added to the bleach solution is preferably 0.01 to 0.1 mole per liter and more preferably between 0.005 and 0.05 mole per liter.

Furthermore, halides (halogenating agents) are included in the bleach so that silver halide salts can form during the bleaching reactions. Halides include bromides, such as potassium bromide, sodium bromide, or ammonium bromide; or chlorides, such as potassium chloride, sodium chloride, or ammonium bromide.

The pH value of the bleach solution is preferably in the range of about 3.0 to 8.0 and most preferably in the range of about 4.0 to 6.5. In order to adjust the pH value to the above mentioned range and to maintain good pH control, a weak organic acid with a pKa between 1.5 and 7, preferably between 3 and 6, such as acetic acid, glycolic acid or malonic acid can be added in conjunction with an alkaline agent such as aqueous ammonia. The buffering acid helps maintain consistence performance of the bleaching reaction.

In addition mineral acids such as hydrochloric acid, nitric acid, sulfuric acid and phosphoric acid can normally be used for the acid component and these acids can be used as a mixture with one or more salt of the weak acids previously mentioned above in order to provide a buffering effect.

Bleaching accelerators, brightening agents, defoaming agents, surfactants, fungicides, anticorrosion agents and organic solvents, such as polyvinylpyrrolidone or methanol, as examples, may be added, if desired.

The bleach replenisher solution can be directly replenished to the bleach solution to maintain chemical concentrations and pH conditions adequate to covert the metallic silver to the ionic state as a silver halide salt. The volume of replenishment solution added per square meter of photographic light-sensitive material can be considered to be a function of the amount of silver present in the photographic light-sensitive material. It is preferred to use low volumes of replenishment solution so low silver materials are preferred. It is also preferred to use ferric complex salts organic acids with organic acid chelating agents that are biodegradable to reduce any undesirable environmental impact.

Other bleaching agents which may be used with this invention include compounds of polyvalent metal such as cobalt (III), chromium (VI), and copper (II), peracids, quinones, and nitro compounds. Typical peracid bleaches useful in this invention include the hydrogen, alkali and alkali earth salts of persulfate, peroxide, perborate, perphosphate, and percarbonate, oxygen, and the related perhalogen bleaches such as hydrogen, alkali and alkali earth salts of chlorate, bromate, iodate, perchlorate, perbromate and metaperiodate. Examples of formulations using these agents are described in *Research Disclosure,* December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as *Research Disclosure.* Useful persulfate bleaches are particularly described in *Research Disclosure,* May, 1977, Item 15704; *Research Disclosure,* August, 1981, Item 20831; DE 3,919,551 and U.S. patent application Ser. No. 07/990,500 filed Dec. 14, 1992. Additional hydrogen peroxide formulations are described in U.S. Pat. Nos. 4,277,556; 4,328,306; 4,454,224; 4,717,649; 4,294,914; 4,737,450; and in EP 90 121624; WO 92/01972 and WO 92/07300.

Especially preferred peracid bleaches are persulfate bleaches. With sodium, potassium, or ammonium persulfate being particularly preferred. For reasons of economy and stability, sodium persulfate is most commonly used.

The bleach time may be about 10 to 240 seconds, with 40 to 90 seconds being a preferred range, and between 25 and 45 seconds being most preferred. The temperature of the bleach solution may be in the range from 20° to 50° C. with a preferred range between 25° and 40° C. and a most preferred range between 35° and 40° C.

To minimize the volume of bleach solution that is needed to process the light-sensitive photographic material, the bleach solution can be recovered and treated to return the chemical concentrations to the replenisher concentration to make up for any chemicals consumed during the bleaching of the light-sensitive photographic material or to compensate for the dilution of the bleach constituents by the carryover of solution from the previous processing stage in the process. The treatment to return the chemical concentrations to the replenisher concentration can be accomplished by the addition of chemicals as solid materials or as concentrated solutions of the chemicals. The degree of recovery of bleach solution can be measured by comparing the volume of solution that can be recovered and reused as a percentage of the original volume that was used in the process. Thus a 90% reuse recovery ratio, would occur when from an original 100 liters of replenisher volume 90 liters would be treated and recovered to produce 100 liters of regenerated bleach replenisher. The recovery reuse ratio of greater than 50% is preferred, greater than 75% is more preferred and greater than 90% is most preferred.

Preferably, a stop bath or a stop-accelerator bath of pH less than or equal to 7.0 precedes the bleaching step and a wash bath may follow the bleach step to reduce the carryover of the bleach solution into the following fixer solution.

When a separate bleach and fixer is used, the fixer includes silver solvents, thiosulfates, thiocyanates, thioether compounds, thioureas, and thioglycolic acid can be used. A preferred component is thiosulfate, and ammonium thiosulfate, in particular is used most commonly owing to the high solubility. If desired, other counter ions may be used in place of ammonium ion. Alternative counter-ions such as potassium, sodium, lithium, cesium as well as mixtures of two or more cations are mentioned and would have advantages to be able to eliminate ammonia from the waste volume.

The concentration of these silver halide solvents is preferably between 0.1 and 3.0 moles per liter and more preferably between 0.2 and 1.5 mole per liter.

As preservatives sulfites, bisulfites, metabisulfites, ascorbic acid, carbonyl-bisulfite adducts or sulfinic acid compounds are typically used. The use of sulfites, bisulfites, and metabisulfites are especially desirable. The concentration of preservatives is preferably present from zero to 0.5 moles per liter and more preferably between 0.02 and 0.4 moles per liter.

The fixer time may be about 10 to 240 seconds, with 40 to 90 seconds being a preferred range, and between 25 and 45 seconds being most preferred. The temperature of the fixer solution may be in the range from 20° to 50° C. with a preferred range between 25° and 40° C. and a most preferred range between 35° and 40° C.

To minimize the volume of fixer solution that is needed to process the light-sensitive photographic material, the fixer solution can be recovered and treated to remove the silver from the solution by means of electrolysis, precipitation and filtration, metallic replacement with another metal, or ion-exchange treatment with a material that will remove the silver. The desilvered solution can then be reconstituted to return the chemical concentrations to the replenisher concentration to make up for the chemicals consumed during the fixing of the light-sensitive photographic material or during the silver recovery treatment process, or to compensate for the dilution of the constituents by the carryover of solution from the previous processing stage in the process. The treatment to return the chemical concentrations to the replenisher concentration can be accomplished by the addition of chemicals as solid materials or as concentrated solutions of the chemicals. The degree of recovery of fixer solution can be measured by comparing the volume of solution that can be recovered and reused as a percentage of the original volume that was used in the process. Thus a 90% reuse recovery ratio would occur when from an original 100 liters of replenisher volume 90 liters would be treated and recovered to produce 100 liters of regenerated fixer replenisher. The recovery reuse ratio of greater than 50% is preferred, greater than 75% is more preferred and greater than 90% is most preferred.

Preferably, following the fixer bath is a wash bath to remove chemicals from the processing solution before it is dried. Preferably the wash stage is accomplished with multiple stages to improve the efficiency of the washing action. The replenishment rate for the wash water is between 20 and 10,000 mL per square meter, preferably between 150 and 2000 mL per square meter. The solution can be recirculated with a pump and filtered with a filter material to improve the efficiency of washing and to remove any particulate matter that results in the wash tank. The temperature of the wash water is 20° to 50° C., preferably 30° to 40° C. To minimize the volume of water being used, the wash water that has been used to process the light-sensitive photographic material can be recovered and treated to remove chemical constituents that have washed out of the light-sensitive photographic material or that has been carried over from a previous solution by the light sensitive material. Common treatment procedures would include use of ion-exchange resins, precipitation and filtration of components, and distillation to recover purer water for reuse in the process.

To minimize the amount of water that is used to wash the light sensitive material, a solution may be employed that uses a low-replenishment rate over the range of 20 to 2000 milliliters per square meter, preferably between 50 and 400 mL per square meter and more preferably between 100 and 250 mL per square meter. When the replenishment rate is reduced, problems with precipitates and biogrowth may be encountered. To minimize these problems, agents can be added to control the growth of bio-organisms, for example 5-chloro-2-methyl-4-isothiazolin-3-one, 2-methyl-4-isothiazolin-3-one and 2-octyl-4-isothiazolin-3-one. To prevent precipitation formation preferable agents which may be added include polymers or copolymers having a pyrrolidone nucleus unit, with Poly-N-vinyl-2-pyrrolidone as a preferred example. Other agents which may be added include a chelating agent from the aminocarboxylate class of chelating agents such as those that were listed previously in the description of developer constituents; a hydroxyalkylidenediphosphonic acid, with 1-hydroylethylidene-1,1-diphosphonic acid being a preferred material; an organic solubilizing agent, such as ethylene glycol; stain-reducing agents such as those mentioned as stain reducing agents for the developer constituents; acids or bases to adjust the pH; and buffers to maintain the pH.

The stabilizer solution may also contain formaldehyde as a component to improve the stability of the dye images. However, it is preferred to minimize or eliminate the formaldehyde for safety reasons. The formaldehyde concentration can be reduced by using materials that are precursors for formaldehyde, examples include N-methylol-pyrazole, hexamethylenetetramine, formaldehyde-bisulfite adduct, and dimethylol urea.

To improve the efficiency of the wash it is preferred to use multiple wash stages with countercurrent replenishment of the stabilizer solution. The wash time may be about 10 to 240 seconds, with 40 to 100 seconds being a preferred range, and between 60 and 90 seconds being most preferred. The temperature of the wash stage bleach-fix solution may be in the range from 20° to 50° C. with a preferred range between 25° and 40° C. and a most preferred range between 35° and 40° C. To further minimize the volume of water being used, the stabilizer solution that has been used to process the light-sensitive photographic material can be recovered and treated to remove chemical constituents that have washed out of the light-sensitive photographic material or that has been carried over from a previous solution by the light sensitive material. Common treatment procedures would include use of ion-exchange resins, precipitation and filtration of components, and distillation to recover purer water for reuse in the process.

Color film Process

The color developer which may be used in this invention for film elements contains any of well-known aromatic primary amine color developing agents. Preferred color developing agents are p-phenylenediamine derivatives, typical, non-limiting examples of which are listed below.

- o-aminophenol
- p-aminophenol
- 5-amino-2-hydroxytoluene
- 2-amino-3-hydroxytoluene
- 2-hydroxy-3-amino-1,4-dimethylbenzene
- N,N-diethyl-p-phenylenediamine
- 2-amino-5-diethylaminotoluene
- 2-aminio-5-(N-ethyl-N-laurylamino)toluene
- 4-[N-ethyl-N-(beta-hydroxyethyl)amion]aniline
- 2-methyl-4-[N-ethyl-N-(beta-hydroxyethyl)amino]aniline
- 4-amino-3-methyl-N-ethyl-N-[beta(methanesulfonamid) ethyl]aniline
- N-(2-amino-5-diethylaminophenylethyl)methanesulfonamide
- N,N-dimethyl-p-phenylenediamine monohydrochloride
- 4-N,N-diethyl-2-methylphenylenediamine monohydrochloride
- 4-(N-ethyl-N-2-methanesulfonylaminoethyl)-2-methylphenylenediamine sesquisulfate monohydrate
- 4-(N-ethyl-N-2-hydroxyethyl)-2-methylphenylenediamine sulfate
- 4-amino-3-methyl-N-ethyl-N-methoxyethylaniline
- 4-amino-3-methyl-N-ethyl-N-beta-ethoxyethylaniline
- 4-amino-3-methyl-N-ethyl-N-beta-butoxyethylaniline
- 4-N,N-diethyl-2,2'-methanesulfonylaminoethylphenylenediamine hydrochloride.

Particularly useful primary aromatic amino color developing agents are the p-phenylenediamines and especially the N,N-dialkyl-p-phenylenediamines in which the alkyl groups or the aromatic nucleus can be substituted or unsubstituted.

These p-phenylenediamine derivatives may take salt forms, for example, sulfate, hydrochlorate, sulfite, and p-toluenesulfonate salts. The aromatic primary amine color developing agents are generally used in amounts of about 0.1 to 20 grams, preferably about 0.5 to 10 grams per liter of the color developer.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents and so forth. The color developer may contain a preservative, for example, sulfites such as sodium sulfite, potassium sulfite, sodium bisulfite, potassium bisulfite, sodium metabisulfite, potassium metabisulfite, and carbonyl sulfite adducts if desired. The preservative is preferably added in an amount of 0.5 to 10 grams, more preferably 1 to 5 grams per liter of the color developer.

Other useful compounds which can directly preserve the aromatic primary amine color developing agents, are for example, hydroxylamines, hydroxamic acids, hydrazines and hydrazides, phenols, hydroxyketones and aminoketones.

Photographic color developing compositions are employed in the form of aqueous alkaline working solutions having a pH of above 7, and most typically in the range of from about 9 to 13. The color developer may further contain any of known developer ingredients.

To maintain the pH within the above-defined range, various pH buffering agents are preferably used. Several non-limiting examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium -5-suflosalicylate), and potassium 5-sulfo-2hydroxybenzoate (potassium 5-sulfosalicate), as well as other alkali metal carbonates or phosphates.

Various chelating agents may be added to the color developer as an agent for preventing precipitation of calcium and magnesium or for improving the stability of the color developer. Preferred chelating agents are organic acids, for example, aminopolycarboxylic acids, organic phosphonic acids, and phosphonocarboxylic acids. Non-limiting examples of these acids include nitrilotriacetic acid,
diethylenetriaminepentaacetic acid,
ethylenediaminetetraacetic acid,
N,N, N-trimethylene phosphonic acid,
ethylenediamine-N,N,N',N'-tetramethylenephosphonic acid,
transcyclohexanediaminetetraacetic acid,
1,2-diaminopropanetetraacetic acid,
hydroxyethyliminodiacetic acid,
glycol ether diamine tetraacetic acid,
ethylenediamine orthohydroxyphenylacetic acid,
2-phosphonobutane-1,2,4-tricarboxylic acid,
1-hydroxyethylidene-1,1-diphosphonic acid, and
N,N'-bis(2-hydroxylbenzyl)ethylenediamine-N,N'-diacetic acid.

The chelating agents may be used alone or in admixture of two or more. The chelating agent is added to the color developer in a sufficient amount to block metal ions in the developer, for example, 0.1 to 10 grams per liter of the developer.

The color developer may contain a development promoter if desired. However, it is recommended for environmental protection, ease of preparation, and color stain prevention that the color developer is substantially free of benzyl alcohol. The term "substantially free" means that the color developer contains only up to 2 ml of benzyl alcohol or does not contain benzyl alcohol. Useful development promoters include thioethers, p-phenylenediamine compounds, quaternary ammonium salts, amines, polyalkylene oxides, 1-phenyl-3-pyrazolidones and imidazoles.

The color developer may further contain an antifoggant if desired. Useful antifoggants are alkali metal halides such as sodium chloride, potassium bromide, potassium iodide and organic antifoggants. Typical examples of the organic antifoggant include nitrogenous heterocyclic compounds, for example, benzotriazole,
6-nitrobenzimidazole,
5-nitroisoindazole,
5-methylbenzotriazole,
5-nitrobenzotriazole,
5-chlorobenzotriazole,
2-thiazolylbenzimidazole,
2-thiazolylmethylbenzimidazole, indazole,
hydrozyazaindolizine, and
adenine.

The color developer used herein may further contain a brightener which is typically a 4,4'-diamino-2,2'-disulfostilbene compound. It is typically used in an amount of 0 to 5 gram/liter, preferably 0.1 to 4 gram/liter.

If desired, various surface active agents, for example alkyl sulfonic acids, aryl sulfonic acids, aliphatic carboxylic acids, and aromatic carboxylic acids may be added.

The temperature at which photosensitive material is processed with the color developer is generally 20° C. to 50° C., preferably 30° C. to 40° C. The processing time generally ranges from 20 seconds to 5 minutes, preferably from 30 seconds to 3⅓ minutes.

The color developing bath may be divided into two or more baths if desired. In this embodiment, the color developer replenisher is preferably supplied to the first or last bath in order to shorten the developing time or reduce the replenishment amount.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Desilvering may be done by separate bleach and fix steps or by a combined bleach-fix. Various combinations of these steps may also be used. Bleaching agents which may be used for film include compounds of polyvatent metal such as iron (III), cobalt (III), chromium (VI), and copper (II), peracids, quinones, and nitro compounds. Typical bleaching agents are iron (III) salts, such as ferric chloride, ferricyanides, bichromates, and organic complexes of iron (III) and cobalt (III). Ferric complexes of aminopolycarboxylic acids and persulfate are most commonly used as bleach agents with ferric complexes of aminopolycarboxylic acids being preferred. Some examples of useful ferric complexes include complexes of:

nitrilotriacetic acid,
ethylenediaminetetraacetic acid,
propylenediamine tetraacetic acid,
diethylenetriamine pentaacetic acid,
ortho-diamine cyclohexane tetraacetic acid
ethylene glycol bis (aminoethyl ether) tetraacetic acid,
diaminopropanol tetraacetic acid,
N-(2-hydroxyethyl)ethylenediamine triacetic acid,
ethyliminodiacetic acid,
cyclohexanediaminetetraacetic acid,
glycol ether diamine tetraacetic acid
methyliminodiacetic acid
diaminopropanetetraacetic acid
ethylenediaminetetrapropionic acid
diaminopropanetetraacetic acid
iminodiacetic acid
ethylenediaminetetrapropionic acid
(2-acetamido) iminodiacetic acid
dihydroxyethylglycine
ethylenediaminedi-o-hydroxyphenylacetic acid In addition, carboxylic acids such as citric acid, tartaric acid, and malic acid; persulfates; bromates; permanganates; and nitrobenzenes may be incorporated.

Preferred aminopolycarboxylic acids include 1,3-propylenediamine tetraacetic acid, methyliminodiacetic acid and ethylenediamine tetraacetic acid. The bleaching agents may be used alone or in a mixture of two or more; with useful amounts typically being at least 0.1 moles per liter of bleaching solution, with at least 0.5 moles per liter of bleaching solution being preferred.

The redox potential of the foregoing bleaching agents is measured by the method described in *Transactions of the Faraday Society,* Volume 55, 1312–1313 (1959). Those bleaching agents having a redox potential of at least 150 mV, preferably at least 180 mV, more preferably at least 200 mV are selected for quicker bleaching. In practice, a bleaching solution containing at least 0.2 mole per liter of a bleaching agent having a redox potential of at least 150 mV ensures rapid bleaching.

In addition, water-soluble aliphatic carboxylic acids such as acetic acid, citric acid, propionic acid, hydroxyacetic acid, butyric acid, malonic acid, succinic acid and the like may be utilized in any effective amount. One or more of these are used in sufficient amount to combat the undesirable increase in blue Dmin which results from bleach induced dye formation as set forth in U.S. Pat. No. 5,061,608. Useful amounts are typically at least 0.35 moles per liter of bleaching solution, with a least 0.7 moles being preferred and at least 0.9 moles being most preferred. Generally speaking, one uses an effective amount below the solubility limit of the acid.

These ferric aminopolycarboxylate complexes are used in the form of salts, for example as sodium, potassium, lithium, cesium or ammonium salts. These may be used alone or in a mixture of two or more. The bleaching solutions may contain other addenda known in the art to be useful in bleaching compositions, such as sequestering agents, sulfites, non-chelated salts of aminopolycarboxylic acids, bleaching accelerators, rehalogenating agents, anti-calcium agents, and/or anti-phosphate agents.

The bleaching solution is generally used at a pH of 0.45 to 9.0, more preferably 3.0 to 6.8, and most preferably 3.5 to 6.0. The bleach replenisher solution is generally at a pH of 0.2 to 8.75, more preferably 3.0 to 6.0 and is adjustable to the pH range of the bleaching solution by adding the bleach starter.

The solutions having a bleaching function are included in the processing procedures as shown below:

(1) development→bleaching→fixing
(2) development→bleach fixing
(3) development→bleach fixing→fixing
(4) development→bleaching→bleach fixing
(5) development→bleaching→bleach fixing→fixing
(6) development→bleaching→washing→fixing
(7) development→washing→bleaching→fixing
(8) development→washing→bleach fixing
(9) development→fixing→bleach fixing
(10) development→prebleach→bleach→optional wash→fix The above mentioned bleach and fixing baths may have any desired tank configuration including multiple tanks, counter current and/or co-current flow tank configurations.

The pH of the developer must be alkaline in order for proper development to occur. In contrast, the pH of the bleach must be acidic. In some processing systems there is a stop bath in between the developer and the bleach which serves to modify the alkalinity of the developer. However, many modern bleaches act as both a stop bath and a bleach for metallic silver. It is therefore necessary to use bleach replenishers which have a lower pH then the bleach tank solutions into which they are replenished. This is done in order to offset the alkaline developer solution which is carried over into the bleach solution by the photographic element. Thus, the bleaching tank solution is generally of higher pH than the bleach replenisher solution.

To start either a batch or replenished bleach tank system it is necessary to make bleach tank from a bleach replenisher solution. Bleach replenisher solutions are many times insufficient to provide desired photographic performance. When starting bleach tanks are prepared, a solution commonly known in the photographic industry as a "bleach starter" is added to the bleach replenisher solution. Water may also be added. The purpose of the bleach starter is to increase the pH of the bleach replenisher to the desired pH of the starting bleach tank solution.

Typically bleach starters are alkaline. Known bleach starters include ammonia, ammonium hydroxide, potassium hydroxide, potassium carbonate, and sodium hydroxide, aqueous ammonia, diethanolamine, monoethanolamine, imidazole, or primary or secondary amine having a hydroxyalkyl radical as an alkaline agent. U.S. Ser. No. 08/183,390, filed Jan. 19, 1994 describes the use of sodium acetate, potassium acetate and ammonium acetate as bleach starters.

The amount of the replenisher for the bleach solution is from 10 ml to 1000 ml, preferably from 30 to 800 ml per square meter. The amount of replenisher for the bleach-fix solution is from 200 to 3000 ml, and preferably from 250 ml to 1300 ml per square meter of the photographic light sensitive material. In this case the replenisher for the bleach-fix solution may be replenished as one part liquid, may be replenished separately as a bleaching composition and a fixing composition, or the replenisher for the bleach-fix solution is prepared by mixing the overflow liquids from a bleach bath and/or a fix bath.

In the present invention, various bleaching accelerators can be added to the bleaching bath and the prebaths thereof. For example, there can be used the compounds having a mercapto group or a disulfide group described in U.S. Pat. No. 3,893,858; German Patent No. 1,290,821; British Patent No. 1,138,842; and Research Disclosure, Vol 17129 (July 1978), the thiourea derivatives described in U.S. Pat. No. 3,706,561, the polyethylene oxides described in German Patent 2,748,430; and polyamine compounds.

The bleaching solution used in the present invention can contain the rehalogenating agents such as bromides (for example potassium bromide, sodium bromide and ammonium bromide), and chlorides (for example potassium chloride, sodium chloride and ammonium chloride). The concentration of the rehalogenating agent is 0.1 to 5.0 mole, preferably 0.5 to 3.0 mole per liter of the processing solution. Furthermore, ammonium nitrate is preferably used as an anticorrosion agent to protect metal.

In processing, the bleaching solution containing the ferric complex salt of an aminopolycarbozylic acid is subjected to aeration to oxidize the formed ferric complex salt of aminopolycarbozylic acid, whereby the oxidizing agent is regenerated and the photographic properties are quite stably maintained.

In the preferred desilvering process, the photosensitive material, after bleached with the bleaching solution as mentioned above, is typically processed in a fixing or bleach-fixing solution which contains a fixing agent.

The fixing agents used herein are wager-soluble solvents for silver halide such as a thiosulfate (e.g., sodium thiosulfate, ammonium thiosulfate, and potassium thiosulfate); a thiocyanate (e.g., sodium thiocyanate, potassium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used.

The concentration of the fixing agent per liter is generally used in the amount of about 0.01 to 2 mole per liter of the fixing or bleach-fixing solution, although 1 to 3 mole per liter of the additional fixing agent may be used to substantially accelerate fixing if desired. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing or bleach-fixing solution may also contain a preservative such as sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite), and bisulfite adducts of hydroxylamine, hydrazine and aldehyde compounds (e.g., acetaldehyde sodium bisulfite). The content of these compounds is about 0 to 0.50 mole/liter, and more preferably 0.02 to 0.40 mole per liter as an amount of sulfite ion. Ascorbic acid, a carbonyl bisulfite acid adduct, or a carbonyl compound may also be used as a preservative.

The bleach-fixing solution may contain any well-known bleaching agents as previously mentioned. Preferred are ferric aminopolycarboxylate complexes. The bleach-fixing solution generally contains 0.01 to 0.5 mole, preferably 0.015 to 0.3 mole, more preferably 0.02 to 0.2 mole of the bleaching agent per liter of the solution.

Further, from the viewpoint of accelerating of fixing, preferably used are above mentioned ammonium thiocyanate (ammonium rhodanate), thiourea and thioether (for example, 3,6-dithia-1,8-octanediol) in combination with thiosulfates. The amount of these compounds used in combination with thiosulfate is 0.01 to 1 mole, preferably 0.1 to 0.5 mole per liter of the processing solution having fixing ability. On some occasions, the use of 1 to 3 mole can increase the fixing-acceleration to a very large extent.

The amount of the replenisher for the fix solution is from 5 to 300 ml, and preferably from 5 to 120 ml per square foot of the photographic light-sensitive material.

The processing composition of the present invention is fundamentally composed of the foregoing color development step and the subsequent desilvering step. It is preferred to employ a wash step and/or a stabilization step after the desilvering step.

Wash water used for the wash step can contain various kinds of surface active agents for prevention the occurrence of water drop unevenness when the color photographic materials are dried. The surface active agents include polyethylene glycol type nonionic surface active agents, polyhydric alcohol type nonionic surface active agents, alkylbenzenesulfonate type anionic surface active agents, higher alcohol surfuric acid ester type anionic surface active agents, alkylnaphthalenesulfonate type anionic surface active agents, amine salt type cationic surface active agents, quarternary ammonium salt type cationic surface active agents, and amino acid type amphoteric surface active agents.

However, since ionic surface active agents combine, as the case may be, with various ions entering with processing to form insoluable materials, a nonionic surface active agent is preferred and an alkyphenolethylene oxide addition product is particularly preferable, alkyphenol, octylphenol, nonylphenol, dodecylphenol and dinonylphenol are particularly preferred. The addition of ethyleneoxide in the range of 8 to 14 moles is preferrable. Furthermore, it is also preferred to use a silicone series surface active agent having a high defoaming effect.

Also, wash water can contain various antibacterial agents or antifungal agents for preventing the growth of fungi in the photographic light-sensitive materials after processing.

These antibacterial agents and antifungal agents include thiazolybenzimidazoles, isothiazolones, and chlorophenols such as trichlorophenol, bromophenols, organothin or organozinc compounds, thiocyanic or isothiocyanic acid compounds, acid amides, diazine or triazines, thioureas, benzotriazolealkylguanidines, quaternary ammonium salts such as benzammonium chloride, antibiotics such as penicillin and the antifungal agents described in *Journal of Antibacterial and Antifungal Agents,* Vol. 11, No. 5, 207–223 (1983).

The relationship of the number of wash tanks and the amount of wash water in a multistage counter-current system can be obtained by the method described in *Journal of the Society of Motion Picture and Television Engineering,* Vol. 64, 248–253 (May 1955). In accordance with the multistage counter-current system described in the above publication, the amount of wash water can be greatly reduced.

The stabilization solution which is used for the stabilization step is one for stabilizing dye images. For example, a liquid containing an organic acid and a buffer of pH from 3 to 6 or a liquid containing aldehyde (e.g., formaldehyde and glutaraldehyde) can be used. Where the stabilization solution is used at the final step it is used in the pH ranging from 4 to 9, preferably from 6 to 8. Where the stabilizing solution of the present invention is used at the final step, the processing temperature is preferably 30° C. to 45° C.; the processing time is preferably 10 seconds to 2 minutes.

The stabilization solution can contain all the compounds which can be added to wash water and also contain, if necessary, ammonium compounds such as ammonium chloride, ammonium sulfite, etc.; compounds of a metal such as Bi, A1, etc.; optical whitening agents; N-methylol compounds as described in U.S. Pat. No. 4,859,574; various kinds of stabilizers, hardening agents, and the alkanolamines described in U.S. Pat. No. 4,786,583, and those described in U.S. Pat. No. 5,217,852, and European Patent Application No. 551,757A1.

For the purpose of preventing scums there are preferably incorporated therein sorbitan esters of fatty acids substituted with ethylene oxide as described in U.S. Pat. No. 4,839,262, and polyoxyethylene compounds described in U.S. Pat. No. 4,059,446, and Research Disclosure, vol 191, 19104 (1980).

In the wash step or the stabilization step, a multistage countercurrent system is preferably used and the number of stages is perferably from 2 to 4. The amount of replenisher is from 1 to 50 times, preferably from 2 to 30 times, and more preferably from 2 to 15 times the amount carried from the pre-bath per unit area.

The water for the wash step or the stabilization step may be city water, but deionized water having Ca and Mg concentrations of less than 5 mg/Liter with ion exchange resins and water sterilized with a halogen or an ultraviolet sterilizing lamp are preferably used. As water for replacing evaporated water, city water may be used, but preferred is deionized water or sterilized water which is preferably used for the wash step or the stabilization step.

The following examples are intended to illustrate but not limit the invention.

EXAMPLES

Example 1

Increased Process Activity

Using the processing sequence described below, samples of Photographic Element A were processed in various seasoning tests in an LVTT processor. The processing solutions were prepared using Developer Replenisher A and the Bleach-fix and Stabilizer Replenishers described below. The tests were monitored with sensitometric strips. Photographic Element A was prepared as follows:

Silver chloride emulsions were chemically and spectrally sensitized as is described below.

Blue Emulsion

A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.74 μm in edgelength size. This emulsion was optimally sensitized by the addition of a water insoluble gold compound and heat ramped up to 60° C. during which time blue sensitizing dye BSD-1, 1-(3-acetamidophenyl)-5-mercaptotetrazole and potassium bromide were added.

Green Emulsion

A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.30 μm in edgelength size. This emulsion was optimally sensitized by addition of green sensitizing dye GSD-1, a water insoluble gold compound, and heat digestion followed by the addition of 1-(3-acetamidophenyl)-5-mercaptotetrazole and potassium bromide.

Red Emulsion

A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.40 μm in edgelength size. This emulsion was optimally sensitized by the addition of a water insoluble gold compound followed by a heat ramp, and further additions of 1-(3-acetamidophenyl)-5-mercaptotetrazole, potassium bromide and red sensitizing dye RSD-1.

Coupler dispersions were emulsified by methods well known to the art, and the following layers were coated on a paper support and hardened with bis(vinylsulfonyl) methyl ether at 1.95 % of the total gelatin weight.

| Layer | Description of Formulation | Amount |
|---|---|---|
| 7 | Gelatin | 1.076 g/m$^2$ |
| | Dioctyl hydroquinone (ST-4) | 0.022 g/m$^2$ |
| | Dibutyl phthalate (S-1) | 0.065 g/m$^2$ |
| | SF-1 | 0.009 g/m$^2$ |
| | SF-2 | 0.004 g/m$^2$ |
| | AD-1 | 0.018 g/m$^2$ |
| | AD-2 | 0.009 g/m$^2$ |
| | AD-3 | 0.007 g/m$^2$ |
| 6 | Gelatin | 0.630 g/m$^2$ |
| | UV-1 | 0.049 g/m$^2$ |
| | UV-2 | 0.279 g/m$^2$ |
| | Dioctyl hydroquinone (ST-4) | 0.080 g/m$^2$ |
| | 1,4-Cyclohexylenedimethylene bis(2-ethylhexanoate) | 0.109 g/m$^2$ |
| | Dibutyl phthalate (S-1) | 0.129 g/m$^2$ |
| 5 | Gelatin | 1.087 g/m$^2$ |
| | Red Sensitive Silver | 0.218 g Ag/m$^2$ |
| | C-3 | 0.423 g/m$^2$ |
| | Dibutyl phthalate (S-1) | 0.232 g/m$^2$ |
| | Butyl carbitol acetate | 0.035 g/m$^2$ |
| | Dioctyl hydroquinone (ST-4) | 0.004 g/m$^2$ |
| 4 | Gelatin | 0.630 g/m$^2$ |
| | UV-1 | 0.049 g/m$^2$ |
| | UV-2 | 0.279 g/m$^2$ |
| | Dioctyl hydroquinone (ST-4) | 0.080 g/m$^2$ |
| | 1,4-Cyclohexylenedimethylene bis(2-ethylhexanoate) | 0.109 g/m$^2$ |
| | Dibutyl phthalate (S-1) | 0.129 g/m$^2$ |
| 3 | Gelatin | 1.270 g/m$^2$ |
| | Green Sensitive Silver | 0.263 g Ag/m$^2$ |
| | M-1 | 0.389 g/m$^2$ |
| | Dibutyl phthalate (S-1) | 0.195 g/m$^2$ |
| | Butyl carbitol acetate | 0.058 g/m$^2$ |
| | ST-2 | 0.166 g/m$^2$ |
| | Dioctyl hydroquinone (ST-4) | 0.039 g/m$^2$ |
| 2 | Gelatin | 0.753 g/m$^2$ |
| | Dioctyl hydroquinone (ST-4) | 0.094 g/m$^2$ |
| | Dibutyl phthalate (S-1) | 0.282 g/m$^2$ |
| | ST-15 | 0.065 g/m$^2$ |
| | F-1 | 0.002 g/m$^2$ |
| 1 | Gelatin | 1.530 g/m$^2$ |
| | Blue Sensitive Silver | 0.280 g Ag/m$^2$ |
| | Y-1 | 1.080 g/m$^2$ |
| | Dibutyl phthalate (S-1) | 0.260 g/m$^2$ |
| | Butyl carbitol acetate | 0.260 g/m$^2$ |
| Support | TiO2/ZnO pigmented polyethylene coated paper | |

| Processing Sequence | |
|---|---|
| Developer | 45 sec |
| Bleach-fix | 45 sec |
| Stabilizer | 90 sec |

Processing Solutions
Developer Solutions and Replenishers

| COMPONENT | REPL A | REPL B | TANK B | TANK C |
|---|---|---|---|---|
| Water | 800 mL | 800 mL | 800 mL | 800 mL |
| Triethanolamine 100% | 5.5 mL | 5.5 mL | 5.5 mL | 13.0 mL |
| N,N Diethylhydroxylamine 85% | 4.00 mL | 8.00 mL | 5.00 mL | 6.00 mL |
| Lithium salt of sulfonated polystyrene | 0.25 mL | 0.25 mL | 0.25 mL | 0.33 mL |
| Stain Reducing Agent | 1.50 g | 1.50 g | 1.00 g | 2.00 g |
| Potassium Sulfite 45% | 0.5 mL | 0.5 mL | 0.5 mL | 0.5 mL |
| Color Developing Agent | 6.00 g | 6.80 g | 4.35 g | 4.50 g |
| Lithium Sulfate | 2.00 g | 2.00 g | 2.00 g | 2.70 g |
| 1-Hydroxyethylidene-1,1-diphosphonic acid 60% | 0.60 mL | 0.60 mL | 0.60 mL | 0.80 mL |
| Pentetic Acid | 0.60 mL | — | — | — |
| Potassium Carbonate | 25 g | 25 g | 25 g | 25 g |
| Potassium Chloride | 4.40 g | 4.50 g | 6.40 g | 2.10 g |
| Potassium Bromide | 0.025 g | 0.025 g | 0.028 g | 0.020 g |
| Potassium Hydroxide, 45% | 3.10 mL | 1.43 mL | — | — |

-continued

| pH | 10.70 ± 0.05 | 10.75 ± 0.05 | 10.10 ± 0.05 | 10.12 ± 0.05 |
|---|---|---|---|---|

Bleach-Fix Replenisher

| COMPONENT | BLEACH-FIX Replenisher |
|---|---|
| Water | 500 mL |
| Ferric Ammonium EDTA | 120 mL |
| Total Iron | 10 g |
| Ammonium Thiosulfate, 58% | 130 mL |
| Sodium Sulfite | 20 g |
| Glacial Acetic Acid | 9.8 mL |
| pH | 5.4 |

Stabilizer Replenisher

| COMPONENT | Stabilizer Repl |
|---|---|
| Polyvinylpyrrolidone | 0.10 g |
| Organo silicone | 0.10 g |
| Substituted thiazolin-3-one | 0.045 g |

The first test (Test 1) was carried out by processing with developer at the standard temperature of 100° F. (37.8° C.) and replenishment of 15 ml/ft$^2$. The second test (Test 2) was made by reducing the temperature of the developer to 95° F. (35° C.) and maintaining the standard replenishment rate of 15 ml/ft$^2$. The third seasoning test (Test 3) was made at the standard developer temperature of 100° F. (37.8° C.) and a reduced replenishment rate of 10 ml/ft$^2$. All replenishment was done using Development Replenisher A. Each test was run to reach an equilibrium position processing an amount of paper to give three tank turnovers. The sensitometric results are shown in Table 1. Test 4 has been added for comparison.

The reduced replenishment rate in test 3 reduces the color developing agent in the tank by 18%, thereby reducing the chemical load in the effluent while maintaining the process activity. (See Table 2)

TABLE 1

| TEST | NEUTRAL EXPOSURE 1 | 2 | 3 | 4 |
|---|---|---|---|---|
| DEVELOPER (TEMP-REP RATE) | 100°-15 mL | 95°-15 mL | 100°-10 mL | 100°-15 mL |
| Processor Type | LVTT | LVTT | LVTT | Conventional |
| RED Dmin | 0.108 | 0.106 | 0.107 | 0.104 |
| GREEN Dmin | 0.113 | 0.108 | 0.112 | 0.100 |
| BLUE Dmin | 0.124 | 0.114 | 0.122 | 0.111 |
| RED Speed | 1.04 | 1.01 | 1.02 | 1.00 |
| GREEN Speed | 1.05 | 1.03 | 1.03 | 1.00 |
| BLUE Speed | 1.05 | 1.01 | 1.03 | 0.995 |
| RED D-Max | 2.64 | 2.63 | 2.60 | 2.40 |
| GREEN D-Max | 2.60 | 2.58 | 2.52 | 2.52 |
| BLUE D-Max | 2.58 | 2.54 | 2.44 | 2.31 |

TABLE 2

| TEMPERATURE-REP RATE | pH | CD-3 g/L | BD-89 mL/L | KCl g/L |
|---|---|---|---|---|
| Resulting Tank Concentrations | | | | |
| 100° F.-15 ml/ft$^2$ | 10.20 | 3.8 | 3.4 | 5.80 |
| 95° F.-15 ml/ft$^2$ | 10.21 | 4.0 | 3.3 | 5.88 |
| 100° F.-10 ml/ft$^2$ | 10.06 | 3.3 | 3.1 | 6.50 |

The advantage of the of the LVTT design is shown in Test 1 vs. Test 4 as an increase in the sensitometric activity of the process. These data indicate that the increased reaction rate with the LVTT gives an advantage that can be taken either as 1) operation at a lower temperature, which would reduce oxidation and evaporation effects or 2) operation at a 33% replenishment rate reduction, which reduces the number of mixes that need to be made by the operator and reduces the amount of waste solution that needs to be discarded. Since time and temperature can usually be traded-off, the higher activity could also be taken as a shorter developer time, which would allow a shorter access time and smaller processor design for a given productivity. Similar improvements in efficiency would be expected in the bleach-fix and wash sections of the processor.

Example 2

Advantage of Low Volume Thin Tank

To consider the advantage of the LVTT for utilization effects, two processors processing 8×10 sheets of paper are compared. One processor is a conventional processor having a 10 Litre Volume. The preferred LVTT processor design has a tank volume of 1.5 Litres. The following table compares the tank-turnover rate of the two processor examples for utilizations between 10–8×10 and 100–8×10 sheets per day replenished at 15 mL/ftsq.

TABLE 3

| 8 × 10's Per Day | Days For One Tank-Volume Turnover: 10 Liter Conventional | 1.5 Liter LVTT |
|---|---|---|
| 10 | 120 Days | 18 Days |
| 25 | 48 Days | 7 Days |
| 100 | 12 Days | 2 Days |

Typically for silver chloride paper emulsion systems, the developer for 'normal' utilization operation is recommended to have a Tank-turnover rate of 28 days or less to avoid the adverse sensitometric effects of oxidation and evaporation. The previous table shows that in the conventional 10-Litre tank, the long turnover rates exceed the developer recommendations and would require special formulations and considerable attention by the operator to compensate for the low utilization conditions. This would all be seen to be inconvenient and complicated by the operator. On the other hand, the 1.5-Litre LVTT processor has a tank-turnover rate that is rapid, which would minimize the effects of the lower utilization operation. The design of processing chemicals for the LVTT would require less preservative protection, having a cost advantage and the operator would see the system as considerably more convenient to maintain and operate under low utilization conditions. Further, the operator would only have to handle 1.5-Litres of solution to fill the developer tank. There would be an associated convenience and savings using the LVTT for the bleach-fix and stabilizer tanks.

Example 3

The oxidation-evaporation of LVTT processors is less than standard minilabs because of the reduced surface area of the solution. The surface area is reduced by as much as 50–70%. The solution surface area of an LVTT developer tank was determined to be 12 $in^2$ and that of a standard 18 Litre tank was measured at 36 $in^2$. The two systems were evaluated for actual evaporation.

A KODAK System 50 minilab paper processor and an LVTT paper processor were filled with standard paper processing solutions. Both processors, without processing any paper, were allowed to heat at an operating temperature of 100 degrees F all day. After 8 hours, they were turned off and the covers partially removed. The next morning they were each topped-off with a measured amount of water. The range of evaporation over 5 days in the LVTT was 75–100 mL in a 24 hour period compared to 175–250 mL for a standard minilab.

The design of the LVTT, with its lower oxidation-evaporation rates and its small tank volumes, minimizes utilization concerns by replacing the tank solutions with fresh solutions at a higher rate than standard minilabs. This feature also reduces the propensity for the components in the solutions to crystallize out onto the tank walls and rollers, particularly at the solution-air interface, reducing the need for additional maintenance.

The lower evaporation rates also reduce the release of vapors into the lab environment, reducing air emission concerns and odors into the lab. Testing has shown an increase in antioxidants because of the reduction in oxidation and the increased rate at which the solutions are replaced with fresh solutions. This allows for the reduction of the antioxidants in the developer and the bleach-fix, reducing environmental concerns.

Example 4

The increased process stability in the LVTT system allows for lower replenishment delivery rates while continuing to maintain short tank turnover times. As shown in Table 6, the developer of a standard minilab with a 22 L developer tank, standard replenishment of 15 ml/$ft^2$, and running 50 orders per day would require 5.5 days to turnover. An LVTT processor with a 1.8 L developer tank, and a replenishment rate of 10 ml/$ft^2$, would require 0.65 days to turnover. This rapid turnover rate in a low volume environment is conducive to low replenishment delivery, where the concentrates are replenished directly into the processor at a rate of 4.0–6.0 mL/$ft^2$. Direct replenishment at 4.5 ml/$ft^2$ of the 1.8 Litre developer tank of the LVTT at 50 orders per day would result in 1.45 days per tank turnover. This reduction in replenishment rate and method of replenishment would reduce effluent of the developer alone from 4125 mL/day to 1238 mL/day.

Table 4 shows a typical developer concentrate which may be used for direct replenishment.

TABLE 4

| COMPONENT | COMPONENT LEVEL (Range) |
|---|---|
| PART A | |
| Triethanolamine 99% | 50–350 g/L |
| N,N Diethylhydroxylamine 85% | 50–200 g/L |
| Lithium salt of sulfonated polystyrene | 10–100 g/L |
| Stain Reducing Agent | 1–10 g/L |
| PART B | |
| Color Developing Agent | 100–400 g/L |
| Lithium Sulfate | 20–150 g/L |
| Potassium Sulfite 45% | 10–50 g/L |
| PART C | |
| 1-Hydroxyethylidene-1,1-diphosphonic acid 60% | 0–50 g/L |
| Potassium Carbonate 47% | 250–1200 g/L |
| Potassium Chloride | 0–100 g/L |
| Potassium Bromide | 0–5 g/L |
| Pentetic Acid | 0–10 g/L |

The bleach-fix can also utilize low replenishment delivery in the LVTT. In a standard minilab, the bleach-fix replenishment rate can range from 5 mL/$ft^2$ to 20 mL/$ft^2$, depending on the utilization of the processor. The 5 mL/$ft^2$ rate requires high utilization to maintain stability of the bleach-fix solution. Using the direct replenishment delivery with the LVTT, a three-part bleach-fix can be used with a replenishment rate of 1.40 mL/$ft^2$. A standard minilab at a replenishment rate of 10 mL/$ft^2$, a tank volume of 18.5 Litre and a utilization of 50 orders per day would take 6.67 days for a tank turnover. In contrast, an LVTT processor with a bleach-fix direct replenishment rate of 1.40 mL/$ft^2$ and a tank volume of 1.8 Litre, would be turned over in 4.68 days. This rate reduction, would reduce the effluent from 2750 mL per day to 385 mL per day. The total effluent for the paper process, including reductions which can be realized from the stabilizer would be reduced from 13.2 Litres per day to 4.9 Litres.

Table 5 shows a typical bleach-fix concentrate which may be used for direct replenishment.

TABLE 5

| COMPONENT | COMPONENT LEVEL Range |
|---|---|
| PART A | |
| Ammonium Thiosulfate 58% | 250-1200 g/L |
| Sodium bisulfite | 10-100 g/L |
| Glacial Acetic Acid | 0-40 g/L |
| PART B | |
| Ferric Ammonium EDTA | 250-750 g/L |
| Glacial Acetic Acid | 15-69 g/L |
| PART C | |
| Glacial Acetic Acid | 100-1050 g/L |

TABLE 6

LVTT UTILIZATION EFFECTS

ASSUMPTIONS:
1. 5.5 $ft^2$ of paper per Order
2. LVTT Tank volumes are 1800 ml/1800 ml/4800 ml (Total for Dev/Bi-Fix/Stab)
3. Std minilab volumes used were 22.0 L/18.5 L/59.5 L
4. Carryover and evaporation were not included

| | | 20 Orders/Day (5%) | | 50 Orders/Day (12.5%) | | 250 Orders/Day (62.5%) | |
|---|---|---|---|---|---|---|---|
| | mL/$ft^2$ | mL/Day | Days/TTO | mL/Day | Days/TTO | mL/Day | Days/TTO |
| | | Developer Regenerator LRD (3-Parts + water) | | | | | |
| LVTT | 4.5 | 495 | 3.64 | 1238 | 1.45 | 6188 | 0.29 |
| STD Minilab | 6.0 | 660 | 33.3 | 1650 | 13.3 | 8250 | 2.67 |

TABLE 6-continued

| LVTT UTILIZATION EFFECTS | | | | | | | |
|---|---|---|---|---|---|---|---|
| | | | Developer Replenisher | | | | |
| LVTT | 10 | 1120 | 1.6 | 2750 | 0.65 | 13750 | 0.13 |
| STD Minilab | 15 | 1680 | 13 | 4125 | 5.5 | 20625 | 1.07 |
| | | | Bleach-Fix DRep (3-Parts) | | | | |
| LVTT | 1.40 | 154 | 11.7 | 385 | 4.68 | 1925 | 0.94 |
| STD Minilab | 1.40 | 154 | 120.1 | 385 | 48.05 | 1925 | 9.61 |
| | | | PRIME Bleach-Fix | | | | |
| LVTT | 10.0 | 1100 | 1.6 | 2750 | 0.65 | 13750 | 0.13 |
| STD Minilab | 10.0 | 1100 | 16.8 | 2750 | 6.7 | 13750 | 1.35 |
| | | | PRIME Stabilizer | | | | |
| LVTT | 12.0 | 1320 | 3.64 | 3300 | 1.45 | 16500 | 0.29 |
| STD Minilab | 23.0 | 2530 | 23.5 | 6325 | 9.9 | 31625 | 1.88 |
| | | | TOTAL EFFLUENT | | | | |
| | | Effluent/Day | Effluent/Wk | Effluent/Day | Effluent/Wk | Effluent/Day | Effluent/Wk |
| LVTT w LRD | | 2.0 L | 12.0 L | 4.9 L | 29.5 L | 24.6 L | 148 L |
| LVTT w Std Repl | | 3.5 L | 21.2 L | 8.8 L | 52.8 L | 44.0 L | 264 L |
| STD Minilab w Std Repl | | 5.3 L | 31.9 L | 13.2 L | 79.2 L | 66.0 L | 396 L |

Example 5

Standard minilab with standard replenishment at high and low utilization

A Kodak system 50 minilab was filled with the Developer Tank Solution B and solutions made from the Bleach-fix Replenisher and the Stabilizer Replenisher described in Example 1. The system was run using the processing sequence described in Example 1 at high utilization (approximately 200 orders per day) for 4 weeks. The manufacturer's recommended developer replenishment rate of 15ml/ft$^2$ and bleach-fix replenishment rate of 10 ml/ft$^2$ was used. Developer Replenisher B described in Example 1 was used. By this process the tank solutions were replaced several times. The photographic element utilized was Photographic Element A described in Example 1. The utilization was then reduced to 125 prints (5 Orders) per day and the process was run for four weeks. The same replenishment rates were utilized. Using this process, only one half of the developer solution was displaced with fresh replenisher.

The chemical and sensitometic data for both processing runs is shown in Tables 7 and 8.

TABLE 7

| NEUTRAL EXPOSURE | | | | | | | | |
|---|---|---|---|---|---|---|---|---|
| UTILIZATION | HIGH | | | | LOW | | | |
| WEEK | 1 | 2 | 3 | 4 | 1 | 2 | 3 | 4 |
| RED Dmin | 0.108 | 0.110 | 0.106 | 0.105 | 0.117 | 0.115 | 0.116 | 0.115 |
| GREEN Dmin | 0.110 | 0.110 | 0.106 | 0.104 | 0.118 | 0.125 | 0.123 | 0.124 |
| BLUE Dmin | 0.111 | 0.116 | 0.109 | 0.104 | 0.132 | 0.127 | 0.132 | 0.129 |
| RED Speed | 1.04 | 1.03 | 1.02 | 1.02 | 1.02 | 1.02 | 1.03 | 1.03 |
| GREEN Speed | 1.04 | 1.02 | 1.02 | 1.01 | 1.02 | 1.02 | 1.02 | 1.02 |
| BLUE Speed | 1.03 | 1.02 | 1.01 | 1.01 | 1.01 | 1.00 | 1.01 | 1.01 |
| RED Shldr | 2.18 | 2.20 | 2.16 | 2.16 | 2.18 | 2.23 | 2.26 | 2.29 |
| GREEN Shldr | 2.08 | 2.08 | 2.06 | 2.07 | 2.07 | 2.15 | 2.19 | 2.24 |
| BLUE Shldr | 1.99 | 1.99 | 1.97 | 1.98 | 2.02 | 2.07 | 2.10 | 2.12 |

TABLE 8

| UTILIZATION | HIGH | | | | LOW | | | |
|---|---|---|---|---|---|---|---|---|
| WEEK | 1 | 2 | 3 | 4 | 1 | 2 | 3 | 4 |
| pH | 10.08 | 10.08 | 10.06 | 10.07 | 10.11 | 10.02 | 10.04 | 10.05 |
| CD-3 (g/L) | 4.4 | 4.4 | 4.3 | 4.2 | 3.3 | 3.9 | 3.8 | 3.4 |
| N,N-diethyl | 5.4 | 6.0 | 6.1 | 6.0 | 3.6 | 1.6 | 1.2 | 0.9 |

TABLE 8-continued

| UTILIZATION | HIGH | | | | LOW | | | |
|---|---|---|---|---|---|---|---|---|
| WEEK | 1 | 2 | 3 | 4 | 1 | 2 | 3 | 4 |
| hydroxylamine (ml/L) | | | | | | | | |
| KCl (g/L) | 5.50 | 6.03 | 6.22 | 6.35 | 5.58 | 6.50 | 6.20 | 5.59 |

As can be seen from the above tables, at high utilization, the sensitometric results are good and the chemical results indicate a stable, trouble-free process. With low utilization conditions, D-min increased to an unacceptable level and the upper scale densities increased and went out of control due to loss of preservative. Table 8 demonstrates the loss of preservative.

Example 6

If the volume of a processor tank is significantly reduced as with LVTT Technology, the rate of displacing the developer tank solution is greatly increased thereby improving the process stability and solution stability. At low utilixation, for instance 5 orders per day as shown in Example 5, the process will be significantly more stable. For example, an LVTT processor with the same processor speed as the 18 Litre tank processor in Example 5, would be 1.8 Litres. This would result in 4.5 tank volumes displaced in 4 weeks as compared to the ½ volume displacement in 4 weeks with the 18 Litre tank.

This rapid volume displacement, due to the low tank volume, along with the reduced surface area of the LVTT and the reduced oxidation-evaporation condition of the LVTT processor, gives an opportunity to substantially reduce the replenishment rate. To take full advantage of this opportunity, direct replenishment can be used. If the replenishment rate is reduced to 4.5 mL/ft$^2$ using direct replenishment, processing 5 orders a day will result in a tank turnover in less than three weeks. This eliminates concern for periods of very low productivity.

Example 7

Three color negative films were processed on an LVTT processor using Process C-41RA, a standard film process. The sensitometry results are shown in Table 9.

TABLE 9

| GOLD PLUS 100 | | GOLD ULTRA 400 | | VERICOLOR III |
|---|---|---|---|---|
| (Density) | | | | |
| Red D-min | 0.37 | 0.44 | | 0.20 |
| Green D-min | 0.78 | 0.70 | | 0.60 |
| Blue D-min | 0.97 | 0.94 | | 0.83 |
| Red Step 11 | 1.01 Step 13 | 1.40 | Step 11 | 0.95 |
| Green | 1.45 Step 13 | 1.77 | Step 11 | 1.39 |
| Step 11 | 1.85 Step 13 | 2.29 | Step 11 | 1.61 |
| Blue Step 11 | | | | |
| (.15IR) | | | | |
| Red Speed | 299 | 339 | | 297 |
| Green Speed | 294 | 345 | | 300 |
| Blue Speed | 307 | 361 | | 301 |
| (Contrast) | | | | |
| Red BFC | 0.54 | 0.60 | | 0.62 |
| Green BFC | 0.58 | 0.65 | | 0.66 |
| Blue BFC | 0.69 | 0.76 | | 0.63 |

Example 8

Seasoning Run Advantages of LVTT: Process RA-4 Example

There are times in the use of a process where it is desirable to operate the process to examine its performance in a fully seasoned state. A fully seasoned state is a state where the chemical concentrations and the materials that season out of the sensitized material are at equilibrium and representative of the operating mode that would represent typical customer use of the products. This is particularly useful during the design of a photographic system by a manufacturer of the materials and can be used to verify that the system will operate at the optimum conditions for the system. Another advantage of the LVTT system is that it allows the processor to reach this equilibrium status very rapidly with less materials being required to complete the test.

In Table 10 the advantage of this is demonstrated where there can be-up to a 95% savings in the materials in addition to significant labor saving to operate the test. The example in the table compares the materials and labor required to complete a test for the paper processor developer solution to the point of three tank turnovers, which nearly represents the fully seasoned characteristics. Two processor designs, a small conventional, deep-tank processor and a LVTT processor are compared.

TABLE 10

Rapid Seasoning Test for a Paper Process Develolper Tank

| | Conventional Deep-Tank Processor | LVTT Processor |
|---|---|---|
| Transport Speed ft/min | 7 ft/min | 6.67 |
| Developer Tank Volume | 40 liters | 1.8 liters |
| Replenishment Rate | 15 mL/ft$^2$ | 15 mL/ft$^2$ |
| Volume of Developer Replenisher for 3 Tank Turnovers | 120 liters | 5.4 liters (−95%) |
| Amount of Paper for 3 Tank Turnovers | 8000 ft$^2$ | 360 ft$^2$ (−95%) |
| Time to Complete 3 Developer Tank Turnovers | 19 hours | 2.7 hours (−85%) |

Example 9

The LVTT processor is compatible with display materials in addition to standard films and papers. A display material was prepared as described above for the Photographic Element A, except that the silver and coupler levels were doubled and the resulting emulsions were coated on a transparent support. The display material was processed in the Developer Tank C Solution and solutions made from the Bleach-fix and Stabilizer Replenishers described in Example 1 using the process sequence described below. The sensitometric data from neutral exposures at the standard process cycle are shown in Table 11 for upper-scale densities for the Red, Green, and Blue layers.

| PROCESS | TIME | TEMP |
|---|---|---|
| Developer | 1'50" | 95° F. |
| Bleach Fix | 1'50" | 95° F. |
| Stabilizer | 3'40" | 95° F. |

TABLE 11

| | |
|---|---|
| R-Shldr. | 2.65 |
| R-Dmax | 2.85 |
| G-Shldr. | 2.55 |
| G-Dmax | 2.80 |
| B-Shldr. | 2.40 |
| B-Dmax | 2.55 |

Example 10

A chromogenic paper, such as described in U.S. Pat. No. 981,566, WO 93/12465, and EP 0 572 629, was processed in an LVTT processor using standard paper chemistry. The sensitometic results are shown in Table 12 below.

TABLE 12

| TEST | NEUTRAL EXPOSURE |
|---|---|
| RED Dmin | 0.123 |
| GREEN Dmin | 0.123 |
| BLUE Dmin | 0.155 |
| RED Speed | 0.93 |
| GREEN Speed | 0.92 |
| BLUE Speed | 0.94 |
| RED D-Max | 2.84 |
| GREEN D-Max | 2.71 |
| BLUE D-Max | 2.68 |

The invention has been described in detail with particular reference to preferred embodiments thereof, but it will be understood that variations and modifications can be effected within the spirit and scope of the invention.

What is claimed is:

1. A method of processing an imagewise exposed color silver halide photographic element comprising developing and desilvering the photographic element in a low volume thin tank processor comprising a processing channel wherein the processor operates at 15% or less of maximum production capacity, said photographic element being processed in said processing channel of said processor, which channel has a thickness equal to or less than about 100 times the thickness of said photographic element being processed, the total amount of each processing solution used in said processing channel being at least 40% of the total volume of the processing solution in the processor, and each of said processing solutions being delivered to said processing channel with a nozzle according to the following formula:

$$1 \leqq F/A \leqq 40$$

wherein F is the flow rate of said processing solution through said nozzle in gallons per minute, and A is the cross-sectional area of said nozzle in square inches.

2. The method of claim 1 wherein the processor operates at 10% or less of maximum production capacity.

3. The method of claim 1 wherein the silver halide element is developed in a developing solution which is replenished by direct replenishment.

4. The method of claim 1 wherein the silver halide element is desilvered in a bleach-fixing solution which is replenished by direct replenishment.

5. The method of claim 1 wherein the silver halide element is desilvered in a bleaching solution and a fixing solution which are replenished by direct replenishment.

6. The method of claim 1 wherein the silver halide content of the photographic element is greater than 90 mole % silver chloride.

7. The method of claim 1 for the processing of color photographic paper, wherein said processing channel has a thickness equal to or less than about 50 times the thickness of said color photographic paper being processed.

8. The method of claim 1 for the processing of color photographic film, wherein said processing channel has a thickness equal to or less than about 18 times the thickness of said color photographic film being processed.

9. The method of claim 3 wherein the developer solution is replenished at the rate of 10 ml or less per $ft^2$ of photographic element surface area.

10. The method of claim 1 wherein the total amount of each processing solution used in said processing channel is at least 50% of the total volume of the processing solution in the processor.

11. The method of claim 1 wherein the silver halide photographic element is a silver bromoiodide film element.

12. The method of claim 3 wherein the developing solution is replenished at the rate of 20 ml or less per roll of element having an area of 0.42 square feet.

13. The method of claim 12 wherein said developer is replenished at a rate of 15 ml or less per roll.

14. A method of processing an imagewise exposed color silver halide photographic element comprising developing the silver halide element in a developing solution, in a low volume thin tank processor comprising a processing channel, wherein the developing solution is replenished by direct replenishment, said photographic element being processed in said processing channel of said processor which channel has a thickness equal to or less than about 100 times the thickness of said photographic element being processed, the total amount of each processing solution used in said processing channel being at least 40% of the total volume of the processing solution in the processor, and each of said processing solutions being delivered to said processing channel with a nozzle according to the following formula:

$$1 \leqq F/A \leqq 40$$

wherein F is the flow rate of said processing solution through said nozzle in gallons per minute, and A is the cross-sectional area of said nozzle in square inches.

15. The method of claim 14 wherein the silver halide content of the photographic element is greater than 90 mole % silver chloride.

16. The method of claim 15 wherein the developing solution is replenished at the rate of 10 ml or less per $ft^2$ of photographic element surface area.

17. The method of claim 16 wherein the developing solution is replenished at the rate of 6 ml or less per $ft^2$ of photographic element surface area.

18. A method of processing an imagewise exposed color silver halide photographic element comprising desilvering the photographic element in a bleach-fixing solution or in a bleaching solution and fixing solution, in a low volume thin tank processor comprising a processing channel, wherein the bleach-fix solution or bleaching solution and fixing solution are replenished by direct replenishment, said photographic element being processed in said processing channel of said processor, which channel has a thickness equal to or less than about 100 times the thickness of said photographic element being processed, the total amount of each processing solution used in said processing channel being at least 40% of the total volume of the processing solution in the processor, and each of said processing solutions being delivered to said processing channel with a nozzle according to the following formula:

$$1 \leqq F/A \leqq 40$$

wherein F is the flow rate of said processing solution through said nozzle in gallons per minute, and A is the cross-sectional area of said nozzle in square inches.

19. The method of claim 18 wherein the silver halide element is desilvered in a bleach-fixing solution which is replenished by direct replenishment.

20. The method of claim 19 wherein the silver halide content of the photographic element is greater than 90 mole % silver chloride.

21. The method of claim 20 wherein the bleach-fixing solution is replenished at the rate of 10 ml or less per $ft^2$ of photographic element surface area.

22. The method of claim 21 wherein the bleach-fixing solution is replenished at the rate of 5 ml or less per $ft^2$ of photographic element surface area.

* * * * *

UNITED STATES PATENT AND TRADEMARK OFFICE

CERTIFICATE OF CORRECTION

PATENT NO. : 5,436,118

DATED : July 25, 1995

INVENTOR(S) : Jerel R. Carli et al

It is certified that error appears in the above-indentified patent and that said Letters Patent is hereby corrected as shown below:

Delete claim 13 and replace therefor as follows:

--13. The method of claim 12 wherein said developing solution is replenished at a rate of 15 ml or less per roll of element having an area of 0.42 square feet.--

Col 89, line 53 after "processor" insert --,--

Signed and Sealed this

Fifth Day of December, 1995

*Attest:*

*Attesting Officer*

Bruce Lehman

BRUCE LEHMAN

*Commissioner of Patents and Trademarks*